US006351964B1

(12) United States Patent
Brancheau et al.

(10) Patent No.: US 6,351,964 B1
(45) Date of Patent: Mar. 5, 2002

(54) REACH-IN REFRIGERATED COOLER

(75) Inventors: Harry A. Brancheau, Inman; Robert J. Reese, Spartanburg; Karl F. Jobst, Spartanburg; Richard D. Kusel, Spartanburg, all of SC (US)

(73) Assignee: Specialty Equipment Companies, Inc., Aurora, IL (US)

( * ) Notice: Subject to any disclaimer, the term of this patent is extended or adjusted under 35 U.S.C. 154(b) by 0 days.

(21) Appl. No.: 09/605,904

(22) Filed: Jun. 28, 2000

(51) Int. Cl.[7] ..... A47F 3/04

(52) U.S. Cl. ..... 62/249; 62/264; 211/74; 211/59.2; 312/118; 312/128

(58) Field of Search ..... 62/249, 255, 264, 62/447; 312/114, 116, 118, 128, 129, 130; 211/74, 85.31, 59.2

(56) References Cited

U.S. PATENT DOCUMENTS

| | | | | | |
|---|---|---|---|---|---|
| 708,043 | A | * | 9/1902 | Hicks | 62/264 |
| 2,201,265 | A | | 5/1940 | Hill | |
| 2,397,403 | A | | 3/1946 | Bishop | |
| 2,459,243 | A | * | 1/1949 | Schwartz | 62/264 |
| 2,499,089 | A | | 2/1950 | Brill et al. | |
| 2,504,520 | A | | 4/1950 | Greiling | |
| 2,632,313 | A | * | 4/1953 | Fehr | 62/264 |
| 3,097,899 | A | | 7/1963 | Dean et al. | |
| 3,287,073 | A | | 11/1966 | Holtkamp | |
| 3,359,755 | A | * | 12/1967 | Creech | 62/447 |
| 3,590,594 | A | * | 7/1971 | Raymond et al. | 62/447 |
| 4,288,992 | A | * | 9/1981 | Eliason | 312/116 |
| 4,598,828 | A | | 7/1986 | Young et al. | |
| 4,836,622 | A | * | 6/1989 | Ferguson | 312/114 |
| 4,977,754 | A | * | 12/1990 | Upton et al. | 62/255 |
| 4,979,376 | A | | 12/1990 | Biehl et al. | |
| 5,046,328 | A | | 9/1991 | Yoshida et al. | |
| 5,277,486 | A | | 1/1994 | Bustos | |
| D386,216 | S | | 11/1997 | Cihanek | |
| 5,813,569 | A | | 9/1998 | Cihanek | |

OTHER PUBLICATIONS

Beverage–Air Curve dated May 12, 1997.
Beverage–Air Cold–Flo Gravity Shelf Organizer Brochure (May 1990).
Beverage–Air Cold–Flo Phase II One Piece Gravity Organizer Brochure (May 1990).
Beverage–Air Brochure for Model MT52–C (1977).
Beverage–Air Slide Door Marketeers Brochure for Models MT 33, 38, 45, 66 (1986).
Beverage–Air Floral Cabinet Model FC45GE Brochure (May 1990).
Electrify MRI Color Brochure, 2 pages, at least as early as Oct., 1998.
Cavalier Color Brochure for Sobe Modular Cooler.

* cited by examiner

*Primary Examiner*—William E. Tapolcai
*Assistant Examiner*—Mohammad M. Ali

(57) ABSTRACT

A refrigerated beverage merchandiser is provided which has a display case for the placement and viewing of product housed within the merchandiser. The display case provides for a plurality of individual hangers which position the merchandise for viewing through a transparent window defined by the display case.

24 Claims, 15 Drawing Sheets

Fig. 8A
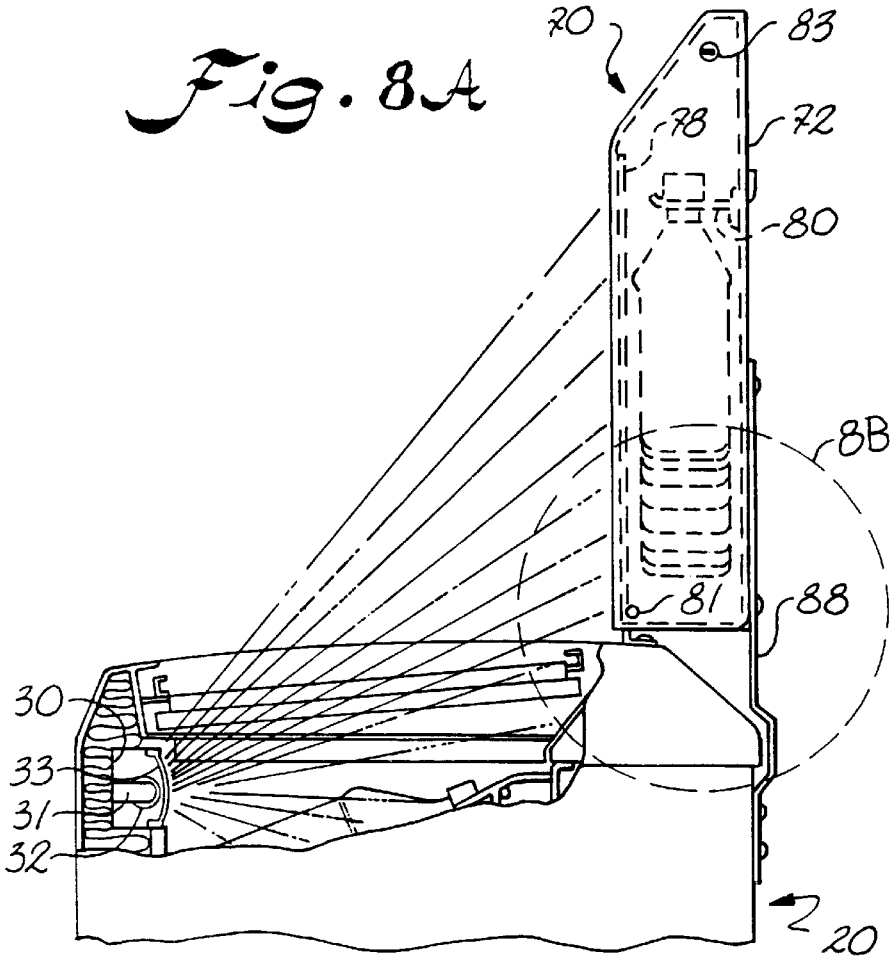
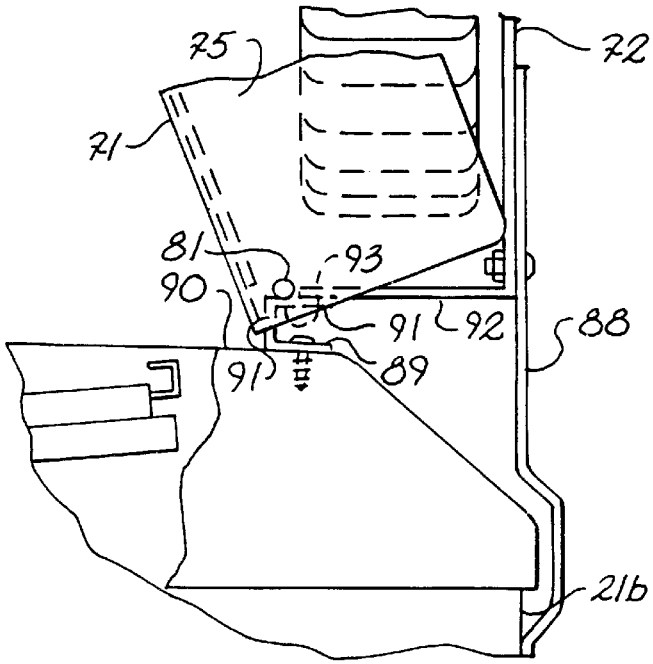
Fig. 8B

REACH-IN REFRIGERATED COOLER

BACKGROUND OF THE INVENTION

The present invention relates to refrigerated coolers and more particularly to coolers that permit access to the product from the top of the cooler, which are known as reach-in type coolers.

This application is a regular application that claims priority to provisional application Ser. No. 60/143,414, filed Jul. 12, 1999.

This application is a continuation-in-part of Design application Ser. No. 29/104,000, filed Apr. 26, 1999; Design application Ser. No. 29,104,064, filed Apr. 27, 1999 (which is a continuation-in-part of Design application Ser. No. 29/104,000, filed Apr. 26, 1999); and Design application Ser. No. 29/112,416, filed Oct. 14, 1999. The above-referenced parent applications are incorporated herein by reference in their entirety.

The sale of cold beverages is facilitated by refrigerated coolers that attract and encourage impulse purchases of the product in individual containers such as twenty ounce bottles. The use of a lighted display to show live examples of the kind of bottles contained in the cooler is known. Such lighted live product displays can be fitted to cover the front exterior wall of the cooler and include a light fixture as well as a horizontal floor on which the bottles are supported behind a transparent window. Typically, the enclosure forming such a product display is formed of sheet metal due to cost considerations that eliminate molded plastic as an optional construction material. However, such product displays are somewhat ordinary in appearance and may not adequately attract the attention of the traffic of potential customers passing in the vicinity of the location where the coolers are placed.

In order to cool the product stored in the cooler to the desired serving temperature and maintain the serving temperature, an efficient cooling mechanism is desired. Cold wall cooling is generally less efficient than forced air cooling. In order to maximize the space available within the storage compartment for containing the product, it is desirable to provide various dividers within the storage compartment to array the product in predetermined rows and columns. However, some divider designs may inhibit air flow and thus reduce the efficiency of forced air cooling within the storage compartment.

Adequate lighting of the product inside the storage compartment is also a concern. As each unit of product is removed from the storage compartment, the next unit of product is at a lower height within the storage compartment. Thus, the location of the focus of the lighting changes as the storage compartment is emptied of product. Yet the customer must have adequate visibility of the next unit of product.

OBJECTS AND SUMMARY OF THE INVENTION

It is a principal object of the present invention to provide an improved live product display for a refrigerated cooler.

It is another principal object of the present invention to provide a live product display for a refrigerated cooler that is more effective in attracting the attention of the traffic of potential customers in the vicinity of the cooler's location.

It is a further principal object of the present invention to provide a live product display that is adaptable to more visually creative display of live examples of the refrigerated product contained in the cooler.

It is still another principal object of the present invention to provide a refrigerated, reach-in cooler having a cooling mechanism that efficiently cools the product stored in the cooler to the desired serving temperature and maintains the product at that serving temperature.

It is yet a further principal object of the present invention to provide a refrigerated, reach-in cooler having a mechanism that maximizes the space available within the storage compartment for containing the product without reducing the efficiency of the mechanism for cooling the product stored in the cooler.

It is a still further principal object of the present invention to provide a refrigerated, reach-in cooler having a mechanism that provides the customer with adequate visibility of the next unit of product notwithstanding the changing level of the product in the storage compartment as each unit of product is removed from the storage compartment.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a refrigerated beverage merchandiser is provided, comprising:

a cabinet defining an exterior and an interior; a storage compartment disposed in the interior of the cabinet and defining an entrance at one end of the storage compartment; a light recess disposed near the entrance of the storage compartment and configured to communicate with the storage compartment; a lighting fixture disposed in the light recess and configured to project light across the entrance of the storage compartment and onto the product stored uppermost in the storage compartment; a plenum disposed in the interior of the cabinet, the plenum defining a fan housing and a return chamber, the fan housing being disposed in an upper portion of the plenum and the return chamber being disposed in a lower portion of the plenum and beneath the fan housing; a divider wall defining an upper section and a lower section disposed beneath the upper section, the divider wall being disposed between the storage compartment and the plenum, the divider wall defining at least one upper air passage in the upper section and at least one air passage in the lower section; a least one top louver defined in the upper section of the divider wall and configured and disposed to direct air to flow through the upper air passage from the fan housing into the storage compartment, the top louver being angled at an acute angle with respect to the vertically least one bottom louver defined in the lower section of the divider wall and configured and disposed to direct air to flow through the lower air passage from the storage compartment into the return chamber; an alignment mechanism disposed and configured in the storage compartment for maintaining the contents of the storage compartment in an orderly array, the alignment mechanism including at least one base tray and at least one cap rack disposed in alignment with and opposed to the base tray, the base tray being configured to receive and surround the bases of a plurality of aligned beverage containers, the cap rack being configured to receive and surround the portions of a plurality of aligned beverage containers that provide access to the beverage stored in the containers; the cap rack being disposed adjacent the top louver and the bottom louver and including a pair of spaced apart wires having opposite ends anchored to the divider wall and having opposite end portions extending outwardly away from the divider wall sufficiently to capture one side of the portions of a plurality of aligned beverage containers that provide access to the beverage stored in the containers that are disposed in the alignment mechanism, the wires having elongated intermediate portions configured to extend for substantially the height of the storage compartment, the wires in each pair being spaced apart to allow sufficient clearance for the portions of a plurality of aligned beverage containers that provide access to the beverage stored in the containers to be disposed between the wires; an evaporator fan disposed in the fan housing, the fan having a rotatable shaft and a blade attached to the shaft, the shaft being disposed at an acute angle relative to the vertical and generally parallel to the acute angle of the top louver; an evaporator disposed in the plenum between the fan housing and the return chamber;

a display case configured for product display and defining an interior and an exterior, the display case being connected to the exterior of the cabinet, the display case defining a housing having a front panel, the front panel defining a window, the display case including a transparent member configured and disposed to cover the window, the display case including a rear wall configured to be selectively joined to the housing to enclose the interior of the display case, the display case including a hanger configured to support at least one unit of the product for visual exposure through the window, the hanger being configured to be selectively attached to the rear wall, the display case including a pivoting mechanism connected to the housing and supporting the housing in selective pivoting movement toward and away from the rear wall of the display case, the display case including a locking mechanism connected to the housing and configured to selectively lock the housing to prevent pivoting movement of the housing away from the rear wall of the display case, the display case including a lighting fixture disposed in the housing and configured to illuminate the interior of the display case from above the hangers when the housing is locked to the cabinet.

The accompanying drawings, which are incorporated in and constitute a part of this specification, illustrate several embodiments of the invention and, together with the description, serve to explain the principles of the invention.

BRIEF DESCRIPTION OF THE DRAWINGS

FIG. 8A is a partial side plan view of an embodiment that is partially cut away and shows some features in dashed line that otherwise would be hidden from view and shows bottles in chain-dashed line;

FIG. 8B is an expanded partial side plan view taken from the circled portion that is labeled 8B in FIG. 8A;

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
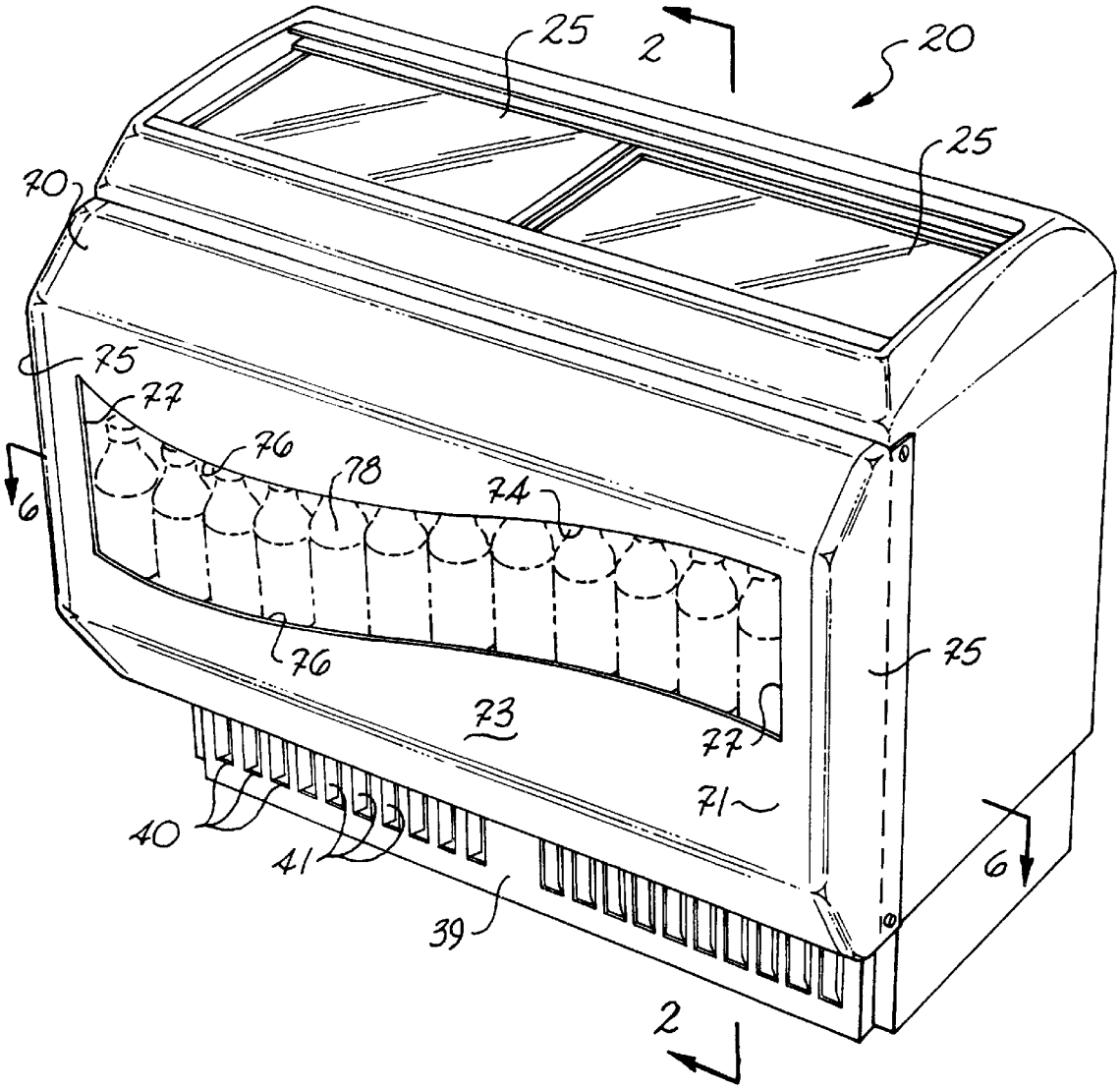
FIG. 1 is an elevated perspective view of a presently preferred embodiment of the present invention.
Figure 2:
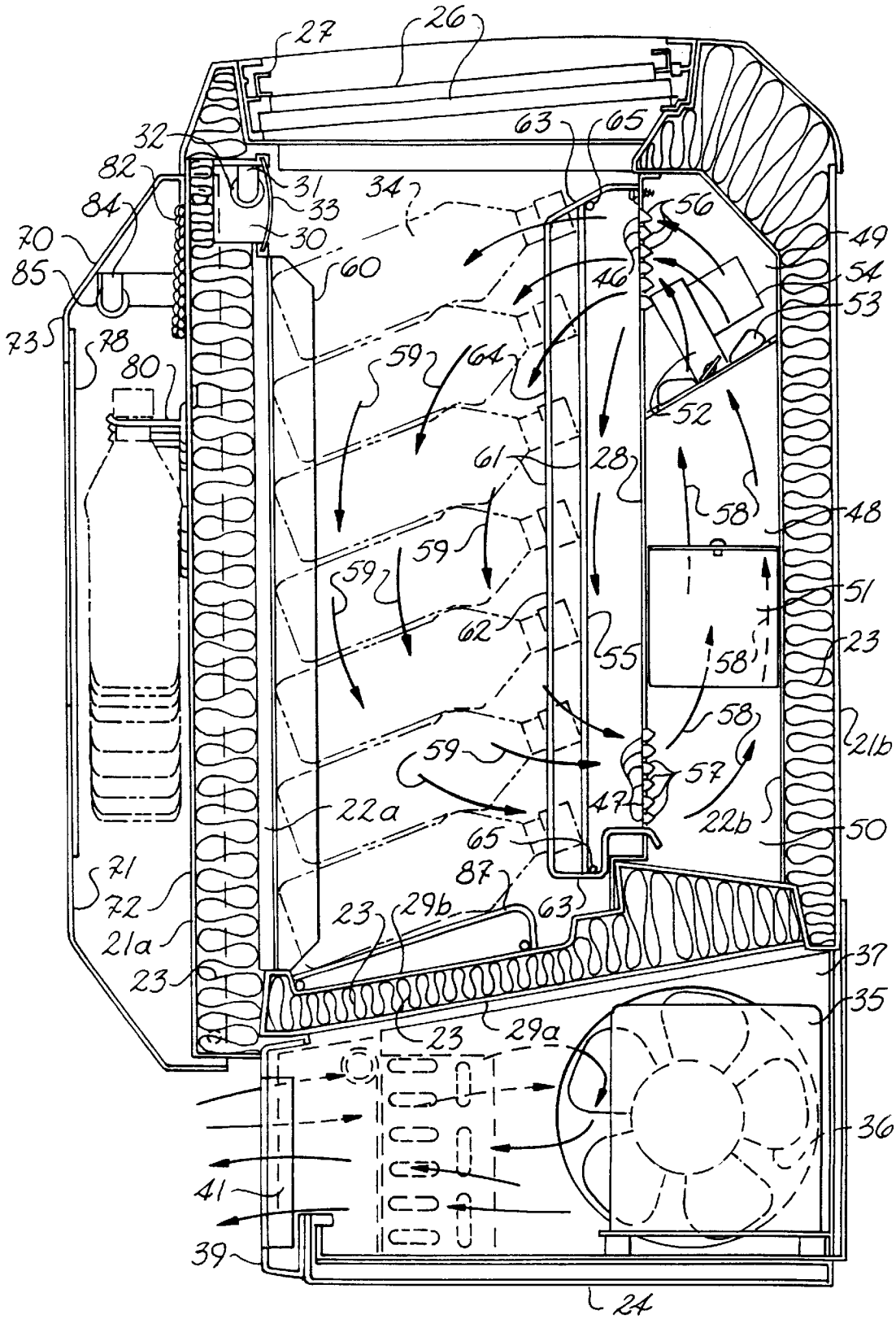
FIG. 2 is a cut-away view taken along the lines of sight indicated by the arrows designated by the numerals 2—2 in FIG. 1.

The refrigerated beverage merchandiser of the present invention includes a cabinet that defines an exterior and an interior. As embodied herein and shown in FIG. 1 for example, the cabinet is generally designated by the numeral 20. The cabinet's front wall, back wall and opposite end walls are heat insulated. As shown in FIG. 2 for example, each of the walls defining the front and back of the cabinet includes a vertically disposed outer shell 21*a*, 21*b*, respectively, that desirably is formed of sheet metal and defines the exterior of the cabinet. Similarly, each of the walls defining the front and back of the cabinet includes a vertically disposed inner shell 22*a*, 22*b*, respectively, that desirably is formed of sheet metal and defines the interior of the cabinet. Heat insulating material 23 (indicated by the wavy lines) is disposed between the two sheet metal shells 21*a*, 21*b* and 22*a*, 22*b* and desirably is composed of polyurethane foam that is blown between the inner and outer shells defining each wall of the cabinet.

As shown in FIG. 2, the bottom wall of the cabinet can include an exterior shell 24 that extends in a horizontal plane and rests against the floor or is slightly raised above the floor by legs or casters. The top of the cabinet defines the opening to the interior of the cabinet. As shown in FIG. 1 for example, access to the interior of the cabinet through the opening is controlled by doors 25, which typically are mounted to slide across the opening, but may be hinged if desired to swing open. Typically, as shown in FIG. 2 for example, each door can include a transparent panel 26 surrounded by a frame 27 formed of metal and/or plastic.

Figure 15:
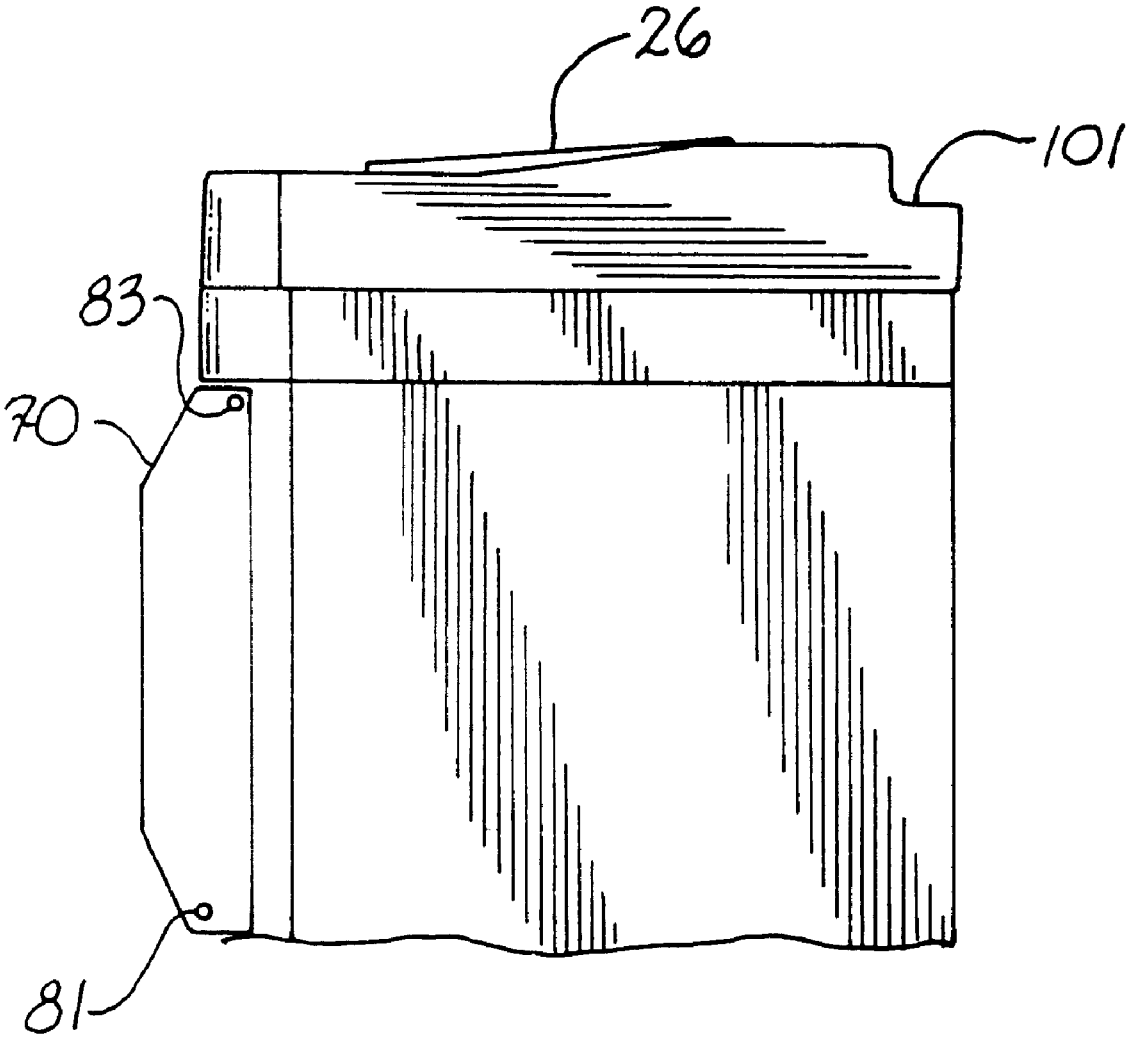
FIG. 15 is a side plan view of an alternative embodiment of the invention setting forth a recessed notch defined within the upper rear wall of the cooler.

A storage compartment is disposed in the interior of the cabinet and defines an entrance at the top of the storage compartment. As embodied herein and shown in FIG. 2 for example, the front interior wall 22*a* of the cabinet defines the front wall of the storage compartment 34. The opposite side walls of the storage compartment are formed by part of the interior side walls of the cabinet. The rear wall of the storage compartment is defined by a divider wall 28 in the form of a sheet metal panel extending between the side walls of the storage compartment. The upper portions of the four vertically disposed walls of the storage compartment define the entrance of the storage compartment, and this entrance coincides generally with the opening of the cabinet. In an alternative embodiment seen in FIG. 15, a rear wall may define a notch or similar recess 101 which facilitates placement along an edge of a check-out counter or similar structure.

The bottom wall of the storage compartment is heat insulated. As shown in FIG. 2, the bottom wall of the storage compartment includes an outer shell 29*a* of sheet metal forming the exterior of the storage compartment, an inner shell 29*b* of sheet metal defining the interior of the storage compartment, and heat insulating material 23 disposed between the two sheet metal shells 29*a*, 29*b*.

A lighting fixture can be provided to project light across the entrance of the storage compartment and onto the product stored uppermost in the storage compartment. As embodied herein and shown in FIGS. 2, 3 and 8A for example, a light recess 30 is disposed near the entrance of the storage compartment and configured to communicate with the storage compartment. As shown in FIGS. 2 and 8A for example, a lighting fixture 31 that holds an elongated flourescent lamp 32 can be configured and disposed in the light recess 30 disposed in the upper front portion of the interior of the refrigerated compartment of the cooler.

Figure 7:
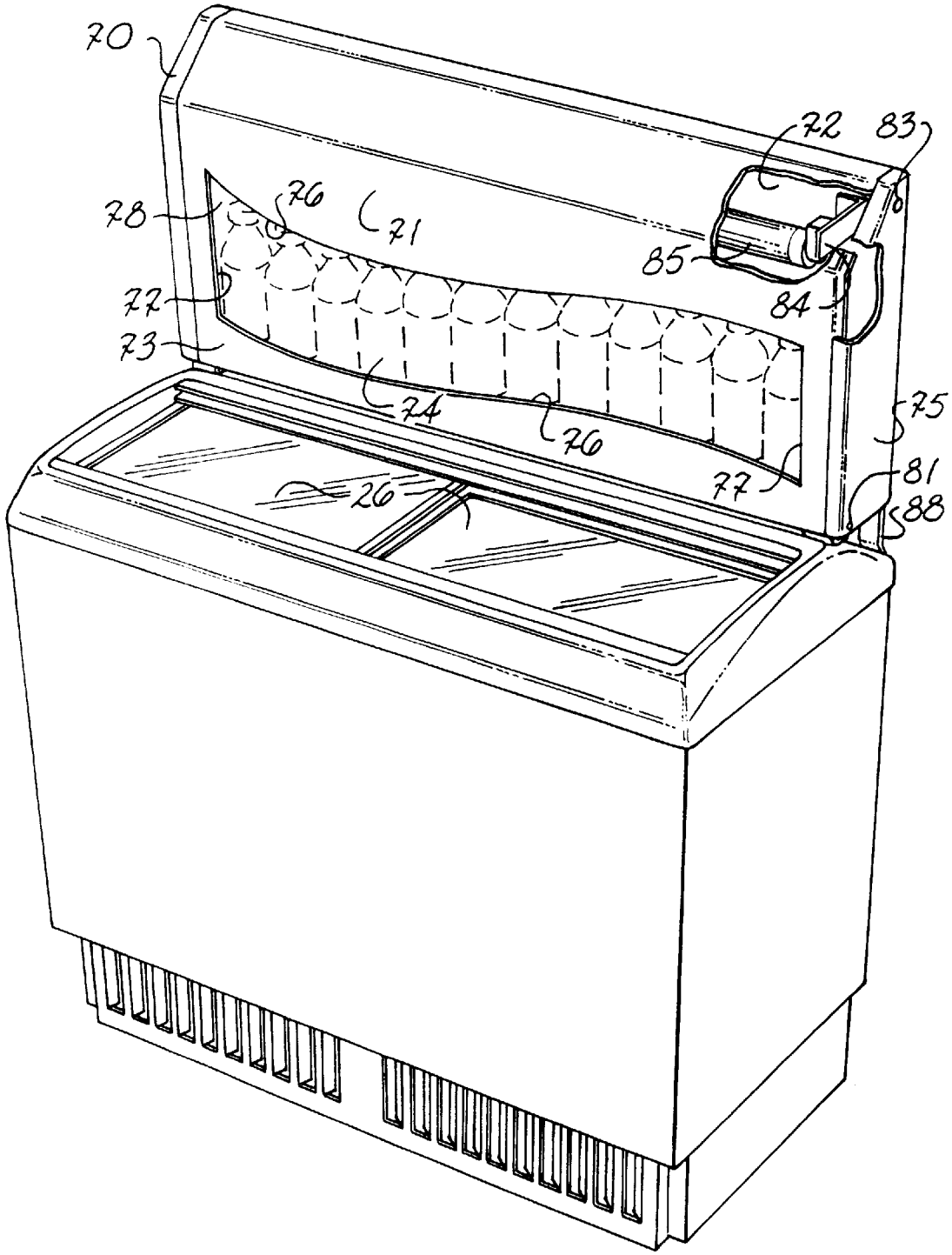
FIG. 7 is an elevated perspective view of another presently preferred embodiment of the present invention.

A transparent cover 33 is provided to close the opening of the light recess 30 to protect the lamp 32 from damage when the containers of product are being removed from the storage compartment. Desirably, the cover 33 can be formed as a lens that directs the light outwardly across the entrance of the storage compartment and downward into the storage compartment in order to reach all areas of the storage compartment, either directly or on reflection from the walls of the storage compartment or the transparent panels 26 of the doors 25 to the cabinet. This lens 33 also can be configured and disposed in order to direct light at the window of a product display case (described below) that can be disposed atop and at the rear of the cooler as shown in FIGS. 7 and 8 for example. Additionally, a reflective shield (not shown) can be provided behind the lamp 32 so as to increase the amount of light that is directed through the lens 33.

The cooler maintains refrigeration around the beverage containers by means of cold air that is generated and mechanically forced to circulate through the storage compartment of the cooler. The cold air is generated by refrigeration equipment that is configured and disposed to provide sufficient cold air to keep the product in the storage compartment at the desired temperature.

Figure 6:
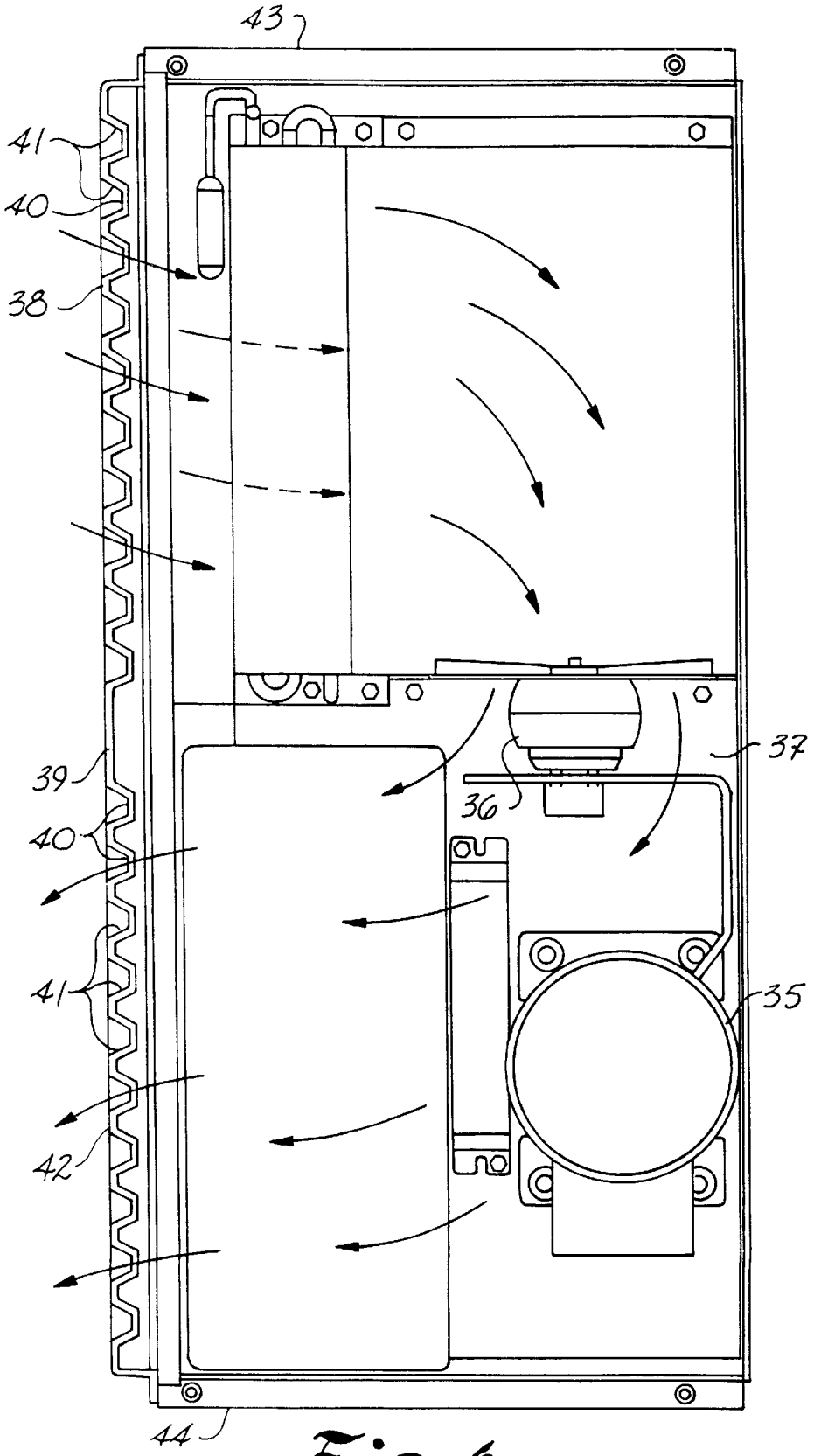
FIG. 6 is a cut-away view taken along the lines of sight indicated by the arrows designated by the numerals 6—6 in FIG. 1.

As shown in FIG. 6 for example, the refrigeration equipment can include a compressor 35 and a compressor fan 36. As shown in FIG. 2 for example, the compressor 35 and compressor fan 36 (partially shown in dashed line) can be disposed in an equipment compartment 37 that is housed beneath the storage compartment of the cabinet. The compressor generates heat that must be dissipated. As shown in FIG. 6, the compressor fan 36 is configured and disposed to draw fresh air into the equipment compartment through one side 38 of a front grill 39 that is provided with openings 40 and associated louvers 41. The compressor fan 36 is further configured and disposed to expel hot air that has been generated by the compressor out of the equipment compartment through the opposite side 42 of the front grill 39 that is also provided with openings 40 and associated louvers 41. The louvers 41 on the one side 38 of the grill 39 are angled away from the center of the cabinet and out toward one end 43 of the cabinet. Similarly, the louvers 41 on the other side 42 of the grill 39 are angled away from the center of the cabinet and out toward the other end 44 of the cabinet. In this way the louvers 41 of the grill 39 are configured to draw the fresh air from the opposite side of the cabinet where the hot air is expelled. The direction of air flow caused by compressor fan 36 is indicated by the arrows in FIGS. 2 and 6 for example. Moreover, because the heat generated by the refrigeration equipment is expelled through a grill 39 disposed in the front of the cabinet, the back and ends of the cabinet can be disposed against a wall or other solid surface such as another cabinet.

As noted above, the cooler of the present invention also includes a divider wall 28 that defines one wall of the storage compartment and desirably the rear wall. The divider wall 28 further defines an upper section and a lower section disposed beneath the upper section. As shown in FIG. 2 for example, the divider wall 28 defines at least one upper air passage 46 in the upper section and at least one lower air passage 47 in the lower section. Desirably, a plurality of upper air passages 46 is defined in the upper section, and a plurality of lower air passages 47 is defined in the lower section of divider wall 28.

In accordance with the present invention, a plenum is disposed in the interior of the cabinet and defines a fan housing and a return chamber. As embodied herein and shown in FIG. 2 for example, the plenum 48 is defined in part by the interior side walls of the cabinet and the interior rear wall 22*b* of the cabinet. The front wall defining the plenum 48 is desirably the divider wall 28 that also functions as the rear wall of the storage compartment 34. As shown in FIG. 2, the divider wall 28 desirably is disposed between the plenum 48 and the storage compartment 34. The fan housing 49 is disposed in an upper portion of the plenum 48, and the return chamber 50 is disposed in a lower portion of the plenum 48 and beneath the fan housing 49.

In accordance with the present invention, the refrigeration equipment can include an evaporator that cools the air flowing through the evaporator. An evaporator fan is disposed so as to draw cooling air through the evaporator. As embodied herein and shown in FIG. 2 for example, the evaporator 51 can be disposed in the plenum 48 between the fan housing 49 and the return chamber 50. An evaporator fan 52 is disposed in the fan housing 49. As is conventional, the fan 52 has a rotatable shaft and a blade 53 attached to the shaft.

In order to conserve space in the fan housing 49, the evaporator fan assembly is configured as compactly as possible. As embodied herein and shown in FIG. 2 for example, the windings 54 of the electric motor that drives the rotation of the fan's shaft and blade 53 are disposed at a right angle with respect to the axis of rotation of the shaft.

This configuration can be accomplished by using a C-frame motor for example.

As embodied herein and shown in FIG. 2 for example, at least one top louver 56 is defined in the upper section of the divider wall 28. Desirably, a plurality of top louvers 56 is provided across the width of upper section of divider wall 28, and each top louver 56 is disposed to correspond and cooperate with a particular upper air passage 46 defined in the divider wall 28. Each top louver 56 is configured and disposed to direct air to flow through the upper air passage 46 from the fan housing into the storage compartment 34. This can be accomplished if, as shown in FIG. 2 for example, the top louver 56 is angled at an acute angle with respect to the vertical. Moreover, the shaft of the evaporator fan 52 is desirably disposed at an acute angle relative to the vertical, and this disposition of the shaft is generally parallel to the acute angle of the top louvers. The direction of the forced air flow is schematically indicated in FIG. 2 by the arrows.

As embodied herein and shown in FIG. 2 for example, at least one bottom louver 57 is defined in the lower section of the divider wall 28. As shown in FIG. 2 for example, a plurality of bottom louvers 57 is provided across the width of the lower section of divider wall 28 and corresponding with each lower air passage 47 defined in the divider wall 28. Each bottom louver 57 is configured and disposed to direct air to flow through the lower air passage 47 from the storage compartment 34 into the return chamber 50. This can be facilitated if, as shown in FIG. 2 for example, each bottom louver 57 is angled at an acute angle with respect to the vertical.

The cold air is introduced into the storage compartment through the plurality of upper air passages 46 formed in the rear inner wall 28 of the storage compartment 34 and via a plurality of top louvers 56 formed in that same wall in the vicinity of the air passages. The air is withdrawn from within the storage compartment 34 by the plurality of lower air passages 47 formed in the rear inner wall 28 of the storage compartment and via a plurality of bottom louvers 57 formed in the lower portion of the rear wall of the storage compartment. The arrows designated by the numeral 58 in FIG. 2 indicate the direction of the air flowing through plenum 48 and represents air flowing from the return chamber to the fan housing. The arrows designated by the numeral 59 in FIG. 2 indicate the direction of the air flowing through the storage compartment 34 and represents air flowing from the fan housing 49 to the return chamber 50.

As seen in reference to the directional arrows of FIG. 2, cooled air from the evaporator may be discharged along top louvers 56 and into the interior of the cooler enclosure. In one embodiment, the pathway of discharged, cooled air may be directed largely along a neck and head space region of containers 86 such as a plurality of stacked, inclined bottles. Return louvers 57 are provided along a lower edge of wall 28 and direct the passage of the air into a lower end of plenum 50. The airflow pattern may direct the cooling air flow to the neck and adjacent shoulder region of the containers 86.

As this portion of the bottle is cooled, a convectional flow is established within each bottle. As the beverage adjacent the neck of each bottle is cooled, the now cooled liquid, being more dense, settles to the bottom of each bottle, displacing the warmer bottle contents toward the bottle neck where the greatest cooling occurs. This circular, convection pathway rapidly chills the beverage within each bottle using a minimum flow volume of chilled air which must be circulated.

The inclined, stacked bottle orientation contributes to the tendency of the chilled air flow to pass predominately along the head space opposite the tops of the bottles. Directing the discharge angle associate with top louvers 56 in a predominately downward direction, will further contribute to the tight air circulation pattern.

As an alternative embodiment, the circulation pattern of cooled air may be varied by adjustments to the discharge angle of cooled air emitted from louvers 56. As a result, a more circular pathway of air flow may be established and which may be useful for products having different shapes or dimensions.

It is also possible to provide a reach-in cooler which uses an air curtain in lieu of a door. An additional set of upper discharge vents may be used to direct a horizontal curtain of air across the opening of enclosure 34. The velocity of air discharged from air curtain vents may be reduced by a baffle or other flow restrictor within the plenum. The reduced velocity helps retain the cold air within the cooler, as opposed to spilling over the edges of the cooler from too great a velocity or turbulence within the airflow.

In the air curtain embodiment, the front interior wall **22*a* defines a plurality of return vents which communicate with an adjacent front plenum defined within the front interior wall 22*a* and extends the height of the enclosure wall 22*a*. The front plenum extends beneath bottom wall 296 and is in further communication with return chamber 50** as best described in related application Ser. No. 60/143,414 incorporated herein by reference.

In accordance with the present invention, the cabinet is provided with an alignment mechanism that is disposed in the storage compartment and configured for maintaining the containers in the storage compartment in an orderly array. The alignment mechanism is configured to align the containers (typically bottles, whether glass or plastic, or aluminum cans) in a manner that maximizes the number of containers that can be stored in the storage compartment of the cooler. It is desirable to store the containers in a succession of vertically disposed columns that are located side-by-side from one end of the storage compartment to the opposite side end of the storage compartment.

Figure 9:
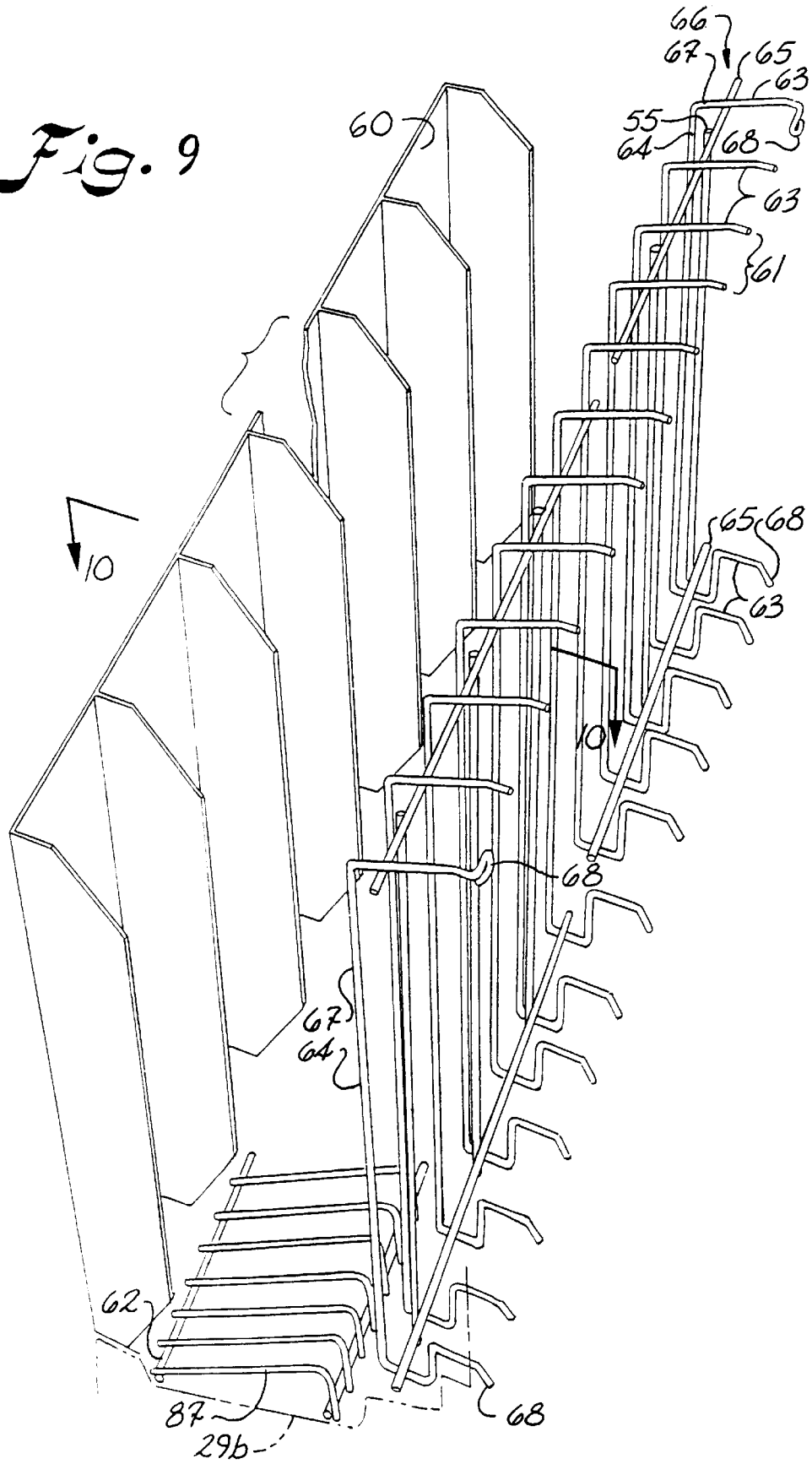
FIG. 9 is an elevated perspective view of components of a presently preferred embodiment of the present invention.

As embodied herein and shown in FIGS. 2 and 9 for example, the alignment mechanism includes at least one base tray 60 and at least one cap rack 61 disposed in alignment with and opposed to the base tray. Desirably, a plurality of pairs of base tray 60 and cap rack 61 is provided within the storage compartment 34 and arrayed from one side of the storage compartment to the other side.

Figure 10:
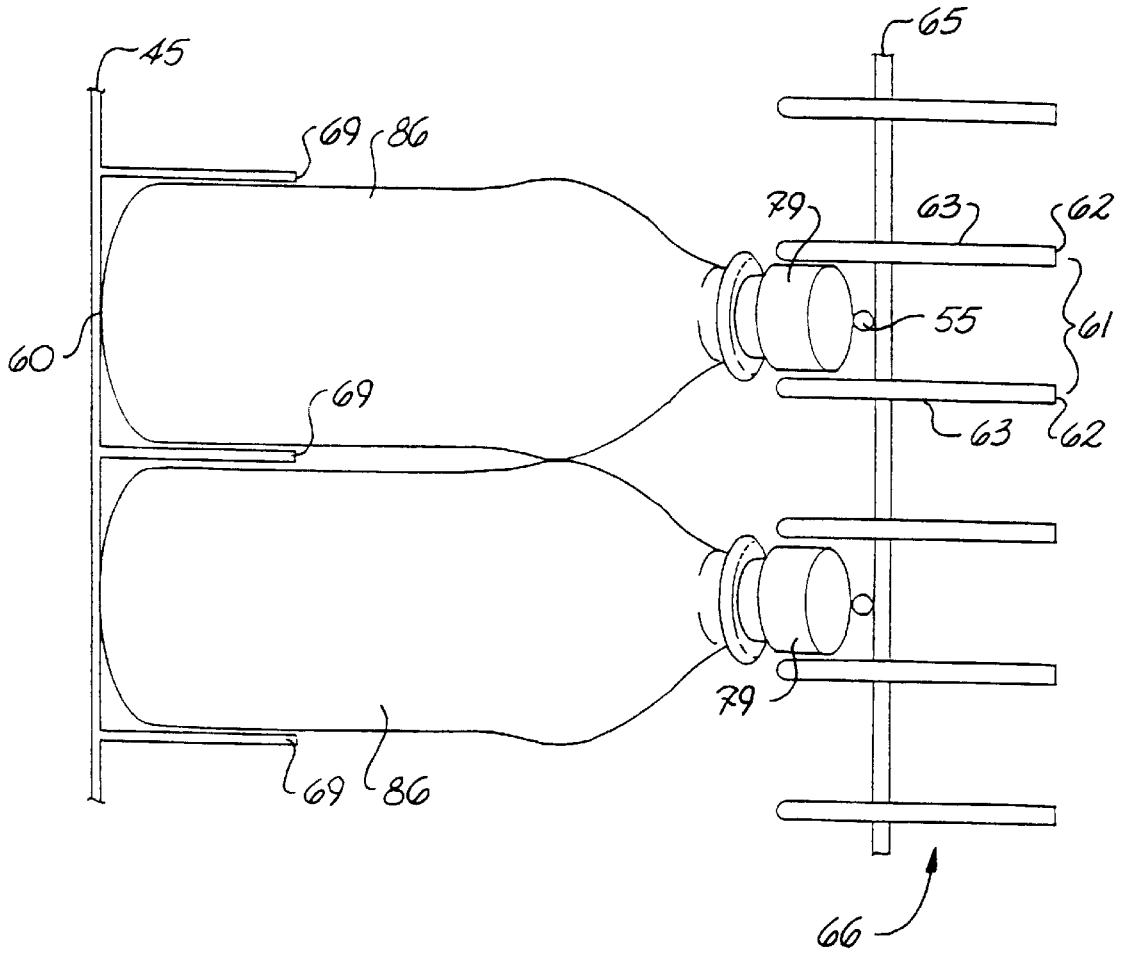
FIG. 10 is a top plan view taken along the lines of sight indicated by the arrows designated by the numerals 10—10 in FIG. 9 and adding bottles.

Each base tray 60 is configured to receive and surround the bases of a plurality of aligned beverage containers. As embodied herein and shown in FIGS. 2 and 9 for example, a base tray 60 defining a length of generally C-shaped sheet metal that is configured to receive the bases of containers stacked in a column one on top of the next container, is provided and disposed at one wall of the storage compartment. Desirably, as shown in FIG. 2, the base tray 60 is disposed against the front wall **22*a* that defines the storage compartment 34. Moreover, as shown in FIGS. 9 and 10 for example, a plurality of base trays can be integrally formed side-by-side in a row. In this embodiment shown in FIGS. 9 and 10 for example, a section of a single sheet 45 forms each base plate, and adjacent trays 60 share a common side member 69**.

Each cap rack 61 is configured to receive and surround particular portions of a plurality of beverage containers aligned in a vertically disposed column. These particular portions are referred to herein as access portions, and are the portions of the containers that provide access to the beverage stored in the containers. As shown in FIG. 10 for example, the access portion of the container can be a twist-off plastic cap 79 when the beverage is stored in a plastic bottle. The access portion of a container that has pull-push tabs for example can be the upper cylindrical section of an aluminum can.

As shown in FIGS. 2 and 9 for example, each cap rack 61 is desirably constructed of a pair of parallel lengths of a stainless steel coated side wire, or epoxy coated wire 62, and a length of stop wire 55 that is disposed between the pair of side wires 62 and lying in a different plane than the side wires. As shown in FIG. 10 for example, each side wire has end portions 63 that extending outwardly away from the divider wall sufficiently to capture one side of the access portions of a plurality of vertically aligned beverage containers 86. Each adjacent pair of end portions 63 of the side wires 62 is separated by a distance that conforms to the size of the access portion of the container to be stored in the cooler. Thus, in the case of bottles, the distance between each pair of adjacent end portions 63 of the side wires 62 is measured to conform to the size of the cap portion of the bottle. When the beverage is stored in an aluminum can that has pull-push tabs, this distance can be the diameter of the upper cylindrical section of the aluminum cans. As shown in FIG. 9 for example, the side wires 62 have elongated intermediate portions 64 configured to extend for substantially the height of the storage compartment 34.

Desirably, as shown in FIG. 9, a wire rack 66 includes an array of cap racks 61, with adjacent cap racks sharing a length of wire 62 in common between them. As shown in FIG. 10, the stop wire 55 of each cap rack 61 is disposed to align with and almost butt against the access portion 79 of each container 86. In this way the stop wire 55 functions to limit travel of the container 86 so as to prevent the container from striking the divider wall 28. As shown in FIG. 9, at least at each opposite end of the wire rack 66 is an anchor wire 67 having its opposite ends 68 configured to be anchored to the divider wall 28.

As shown in FIGS. 9 and 10, wire rack 66 includes a support wire 65 disposed to extend transversely with respect to the side wires 62 and stop wires 55 in each cap rack 61 and at one end of the wire rack 66. Desirably, as shown in FIG. 9, a second support wire 65 is disposed in the same transverse manner with respect to the side wires 62 and stop wires 55 but at the opposite end of the wire rack 66.

As shown in FIGS. 2 and 9, a wedge-shaped wire rack 87 can be disposed to rest on the inner shell **29*b* of the storage compartment and between base tray 60 and wire rack 66. Wedge rack 87 functions to incline the beverage containers 86 with their access portions elevated relative to their base portions as they are stacked in the storage compartment. Wedge rack 87 also functions to reduce the effective length of the container 86 that must be accommodated between the base tray 60 and wire rack 66**.

In order to promote even distribution of the cool air in the storage compartment, it is desirable to minimize obstructions to air flow in the storage compartment other than the containers that will be stored in the storage compartment. Accordingly, as embodied herein and shown in FIG. 2 for example, the wire rack 66 is disposed adjacent the top air passage openings 46 and the bottom air passage 47 openings in the divider wall 28. The wire rack 66 presents very little impediment to the air flow in the region of the storage compartment adjacent the air passage openings 46, 47 that introduce and withdraw the air flow into and from the storage compartment 34 of the cooler.

Figure 13:
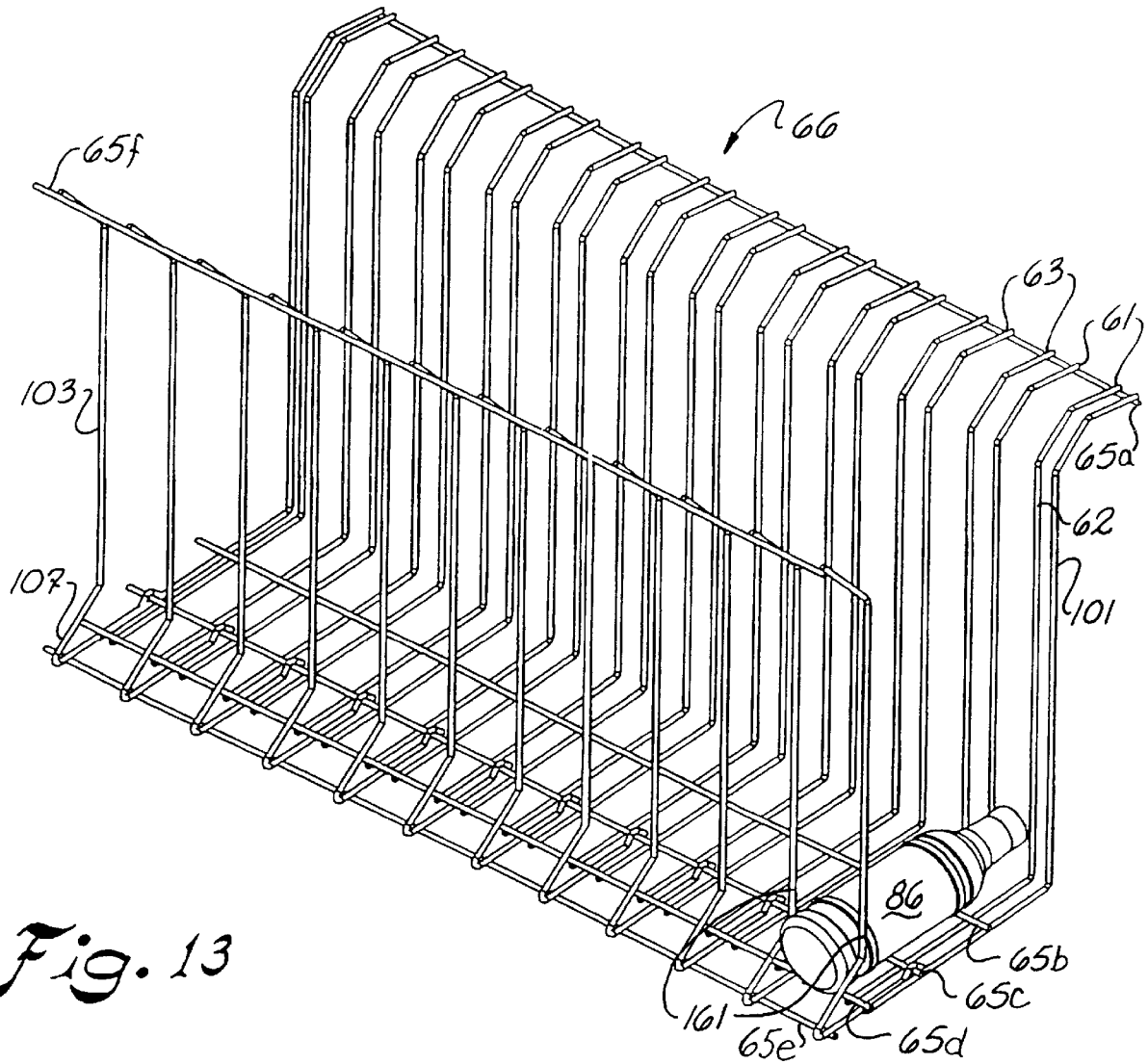
FIG. 13 is an elevated perspective view of components of an alternative embodiment of the present invention.
Figure 14:
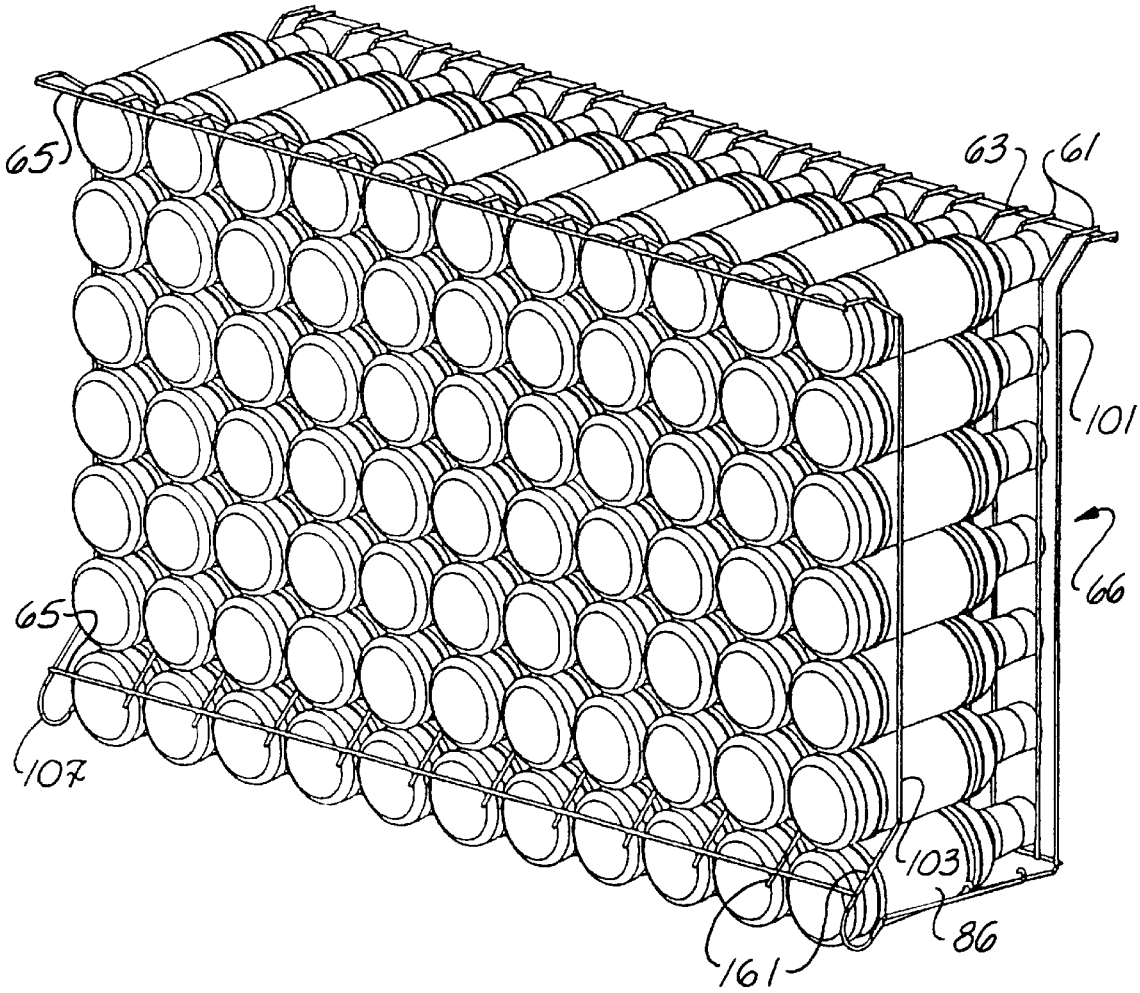
FIG. 14 is an elevated perspective view of components of an additional preferred embodiment of the present invention and setting forth additional details.

Additional embodiment of the wire rack 66 are seen in reference to FIGS. 13 and 14. Wire rack 66 defines a front wall 101, a rear wall 103, and a storage area there between adapted for receiving multiple stacks of packaged beverage products 86. The upper ends of both front wall 101 and rear wall 103 define a curved or bent edge directed away from the storage area and helps maintain a spaced distance of the rear storage area from the respective front and rear interior cooler walls. Rear wall 103 further defines an additional outwardly curved bottom edge 107, bottom edge 107 being in the same plane as the upper edge of rear wall 103. Rear wall 103 further defines a plurality of base racks 161 which are adapted for receiving and retaining therein a base portion of containers 86.

A plurality of transverse support wires **65*a*, 65*b*, 65*c*, 65*d* and 65*e* are used to interconnect elements of support rack 66. As shown in FIG. 13, at the end of the vertically extending portion of the front wall 101 that is opposite the upper end thereof, the front wall 101 defines at a lower end a front wall base portion that extends rearwardly toward the rear wall 103 and includes three spaced apart transverse support members 65*b*, 65*c*, and 65*d*. At the end of the vertically extending portion of the rear wall 103 that is opposite to the upper end thereof, the rear wall 103 defines at a lower end a rear wall base portion that includes a transverse support member 65*e* and extends forwardly toward the front wall 101 and defines a curved hook segment 95. As shown in FIG. 13, the base portion of the rear wall 103 passes under a first transverse member 65*e* of the base portion of the front wall 101, and the curved hook segment 95 of the base portion of the rear wall 103 passes over and engages a second transverse member 65*c* of the base portion of the front wall 101. Rack 66 defines a plurality of cap racks 61 formed by spaced adjacent wires 62 similar to that described above in reference to FIG. 9**.

As seen in reference to the embodiments of FIGS. 13 and 14, racks 66 will support container 86 in a stacked, edgewise configuration. The relative height of rear wall 103 may be varied as illustrated. If desired, a bottle rack 66 may define a wedge similar to wedge 87 (FIG. 9) which would place containers 86 in an inclined-stack configuration. However, as seen in the embodiments of FIG. 13 and 14, the diameter of the base rack 161 and cap rack 61 may be sized as needed to accommodate the diameter of a desired product 86. For instance, a container such as a molded plastic bottle may have a curvature or defined groove as part of the bottle design. The groove or other reduced diameter bottle segment may be used to advantage to allow the bottle base to engage base rack 161 along the curvature or groove of a bottle. As such, the bottle is held in place in part by the inner engagement of the bottle groove within the wire support of base rack 161. Further, the specific dimensions between the rack and a desired bottle design allows for a bottler to control the products which may be placed within the cooler. As such, a rack 66 may be designed to accommodate only a desired bottle configuration and which will not accept a competitor's bottle. As such, the rack dimensions may be used to advantage to engage only select bottle or other product designs.

It is further envisioned that the rear wall 72 of the display case 70 may have defined therein a cavity. The cavity shape defines a mold adapted for partially receiving the displayed product. The molded cavity, corresponding to the specific shape and contour of the container product, helps maintain the product in an organized, attractive manner. Further, the partial nesting of the product within the cavity prevents unwanted movement of the product from vibrations. In addition, the molded cavity precludes the use of a unlicensed or unauthorized product within the display portion of the cooler. Such an ability helps maintain control by the owner of the cooler of the types and brands of products which are associated with the cooler.

In accordance with the present invention, a structure is provided that is configured and disposed for displaying to the potential purchaser, actual containers of the type of product that is refrigerated in the storage compartment. As embodied herein and shown in FIG. 1 for example, this structure is provided in the form of a display case 70 that is attached to the exterior of the cabinet 20. As shown in FIG. 2 for example, display case 70 defines a housing 71 and a rear wall 72 that is configured to be selectively joined to the housing to enclose the interior of the display case. When the display case is to be attached to the front of the cooler as in the embodiment shown in FIG. 2, the rear wall of the display case can be defined by the exterior front wall of the cabinet, including the outer shell 21*a*. Alternatively, when the display case 70 is to be attached to the top of the cooler as in the embodiment shown in FIGS. 7, 8A and 8B for example, a separate rear wall 72 can be provided for the display case.

As shown in FIGS. 7, 8A and 8B, the display case 70 can be configured and disposed to rest atop the cabinet 20. As embodied herein and shown in FIGS. 8A and 8B for example, a mounting bracket 88 is provided to connect the display case 70 to cabinet 20. The upper portion of bracket 88 is connected to display case 70, and the lower portion of bracket 88 is connected to the cabinet's rear wall through outer shell 21*b* of cabinet 20. Desirably, bracket 88 extends across substantially the entire width of cabinet 20 and display case 70. As shown in FIG. 8B, a bottom support flange 89 having a C-shaped cross-sectional profile is attached to the rear section of the top 90 of cabinet 20 and defines a vertically extending flange portion 91 and a rearwardly projecting flange 93 that is configured and disposed to rest against and support the bottom wall 92 of display case 70.

Figure 4:
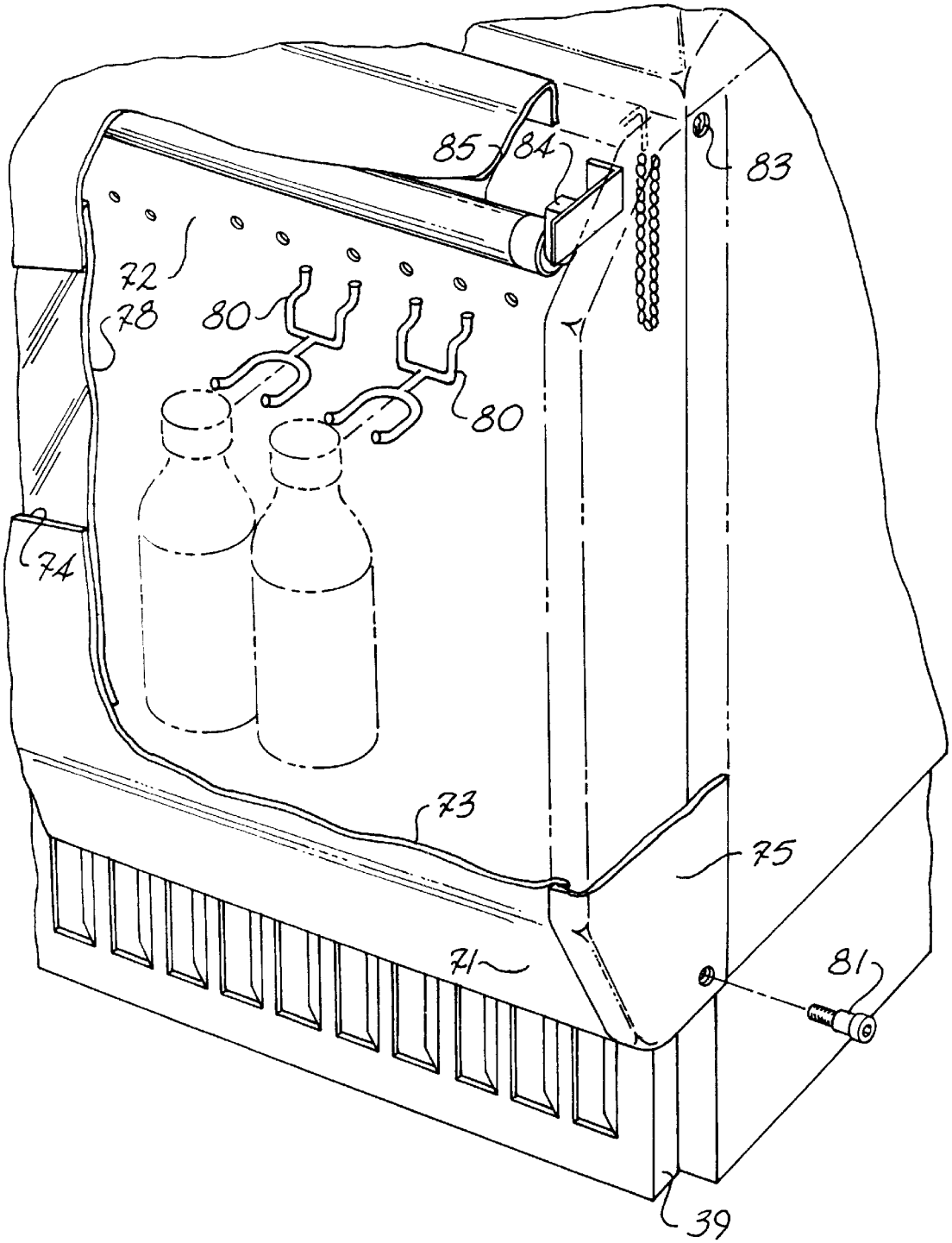
FIG. 4 is an elevated perspective view that is partially cut away and shows some cut away features in chain-dashed line and shows bottles in chain-dashed line.
Figure 5:
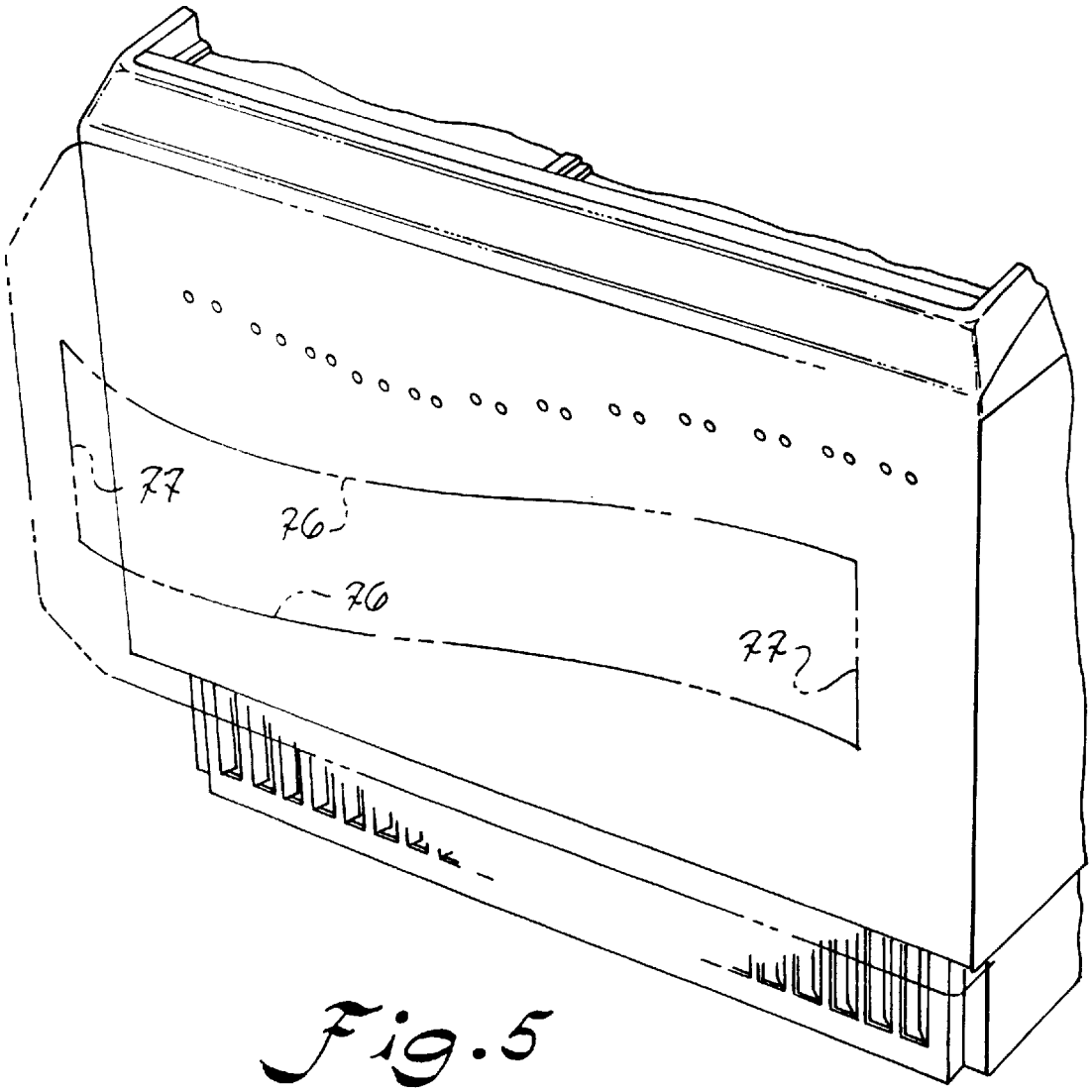
FIG. 5 is an elevated perspective view that is partially cut away and shows some features in chain-dashed line to indicate their relative position without obscuring other features shown in solid line.

As shown in FIGS. 1, 4, 7 and 8A, the housing 71 defines a front panel 73. As shown in FIGS. 1, 4 and 7, the front panel 73 in turn defines an opening 74 for a window, and the housing 71 defines two end panels 75 attached to each end of the front panel 73. The shape of the window's perimeter can be provided in accordance with the desires of the user and thus can be arcuate or have any other desired shape. Thus, any shape that is striking, fanciful and attention-getting can be chosen in order to satisfy a desired image or implement or complement a marketing plan for the product stored in the cabinet. Typically, the upper and lower borders 76 of the display window's opening will be shaped in a parallel fashion as shown in FIGS. 5 and 7 for example, but need not be. Each of the opposed ends 77 of the display window's opening can define a straight linear shape as shown in FIG. 5, but need not be so shaped if a different shape is desired by the user. For example, the shape of the window's perimeter can be polygonal, oval, oblong or circular.

The display case includes a transparent member that is configured and disposed to cover the window yet allow the observer to see inside the display case. As embodied herein and shown in FIGS. 1, 2, 4, 7 and 8A for example, a transparent member 78 such as a sheet of transparent polycarbonate or clear plastic or glass is attached to the interior surface of the front panel 73 and has breadth sufficient to cover the entire display opening. The transparent member 78 can be permanently attached to the interior surface of the front panel 73 as by some adhesive chemical or adhesive tape or some other means of attachment, as desired.

Further, transparent member 78 may be installed by typical glazing techniques so as to be positioned within the perimeter defined by the display opening. Conventional caulking or gaskets may be used to retain the transparent member 78 within the display opening of front panel 73.

In accordance with the present invention, the display case is further configured to permit the beverage containers that are on display in the display case to be arranged in a pattern that mimics the contour of the shape of the window opening. This desirably is accomplished by providing the display case with a mechanism for holding the beverage containers in place so that they are visible through the transparent member covering the window of the display case. As embodied herein and shown in FIGS. 2, 4 and 8A for example, one such mechanism includes a plurality of hangers 80. Each hanger 80 is configured to be selectively attached to the rear wall 72 of the display case. However, permanent attachment is also contemplated. Each hanger 80 can be configured to support at least one unit of the product for visual exposure through the window. The location of each hanger 80 can be disposed as desired by the user. Accordingly, as shown in FIGS. 1–4, 7, 8A and 8B for example, hanging locations can be arranged so that when the beverage containers are carried by the hangers 80, the row of beverage containers will be shaped in conformance with the shape of the window opening 74. By means of the hangers 80, it becomes unnecessary to provide a base support that is shaped in accordance with the shape of the window opening to rest the beverage containers on the base support in a manner that would permit the beverage containers to be arranged in a row that follows the contour of the shape of the window opening.

Figure 11:
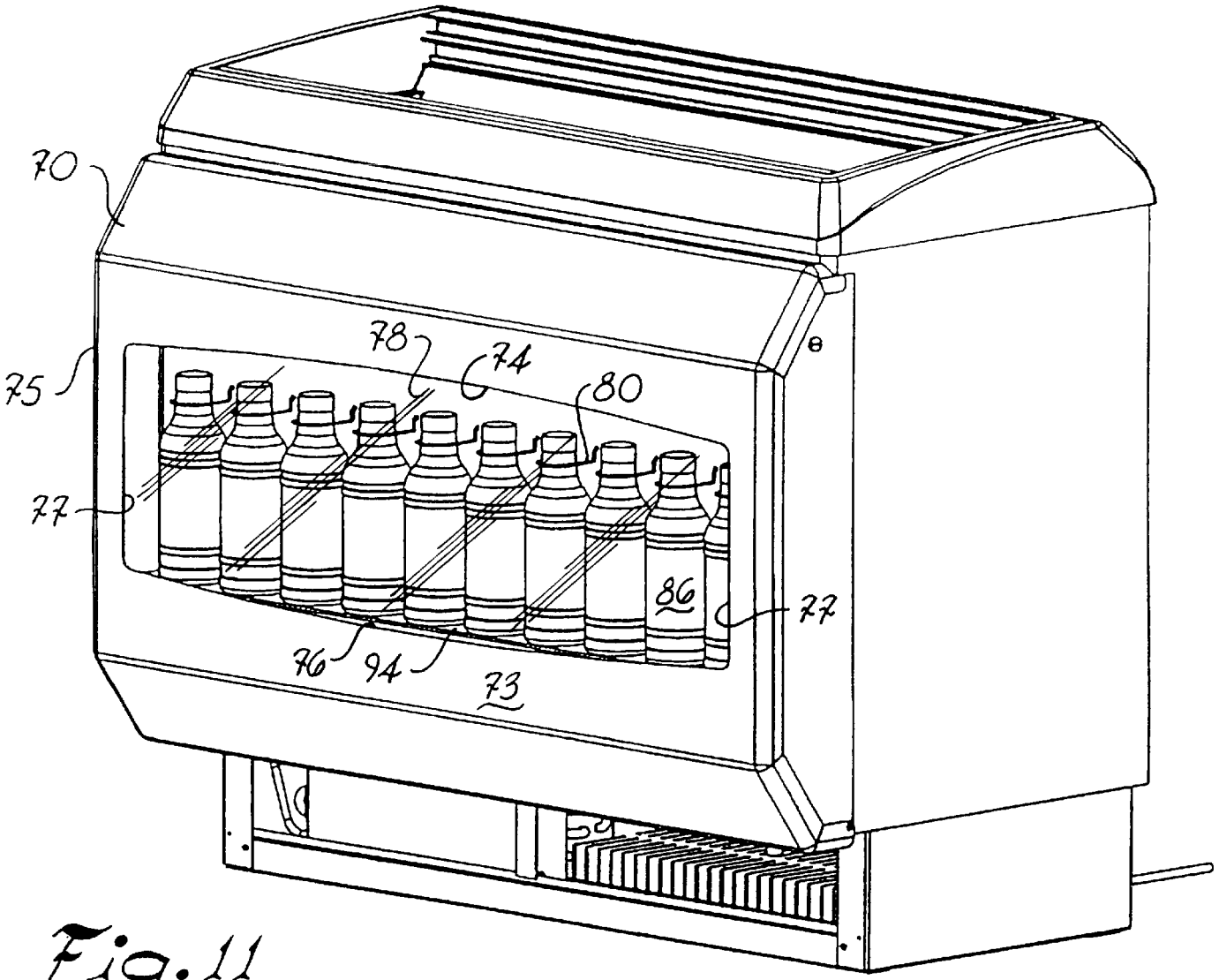
FIG. 11 is an elevated perspective view of an alternative embodiment of the present invention.
Figure 12:
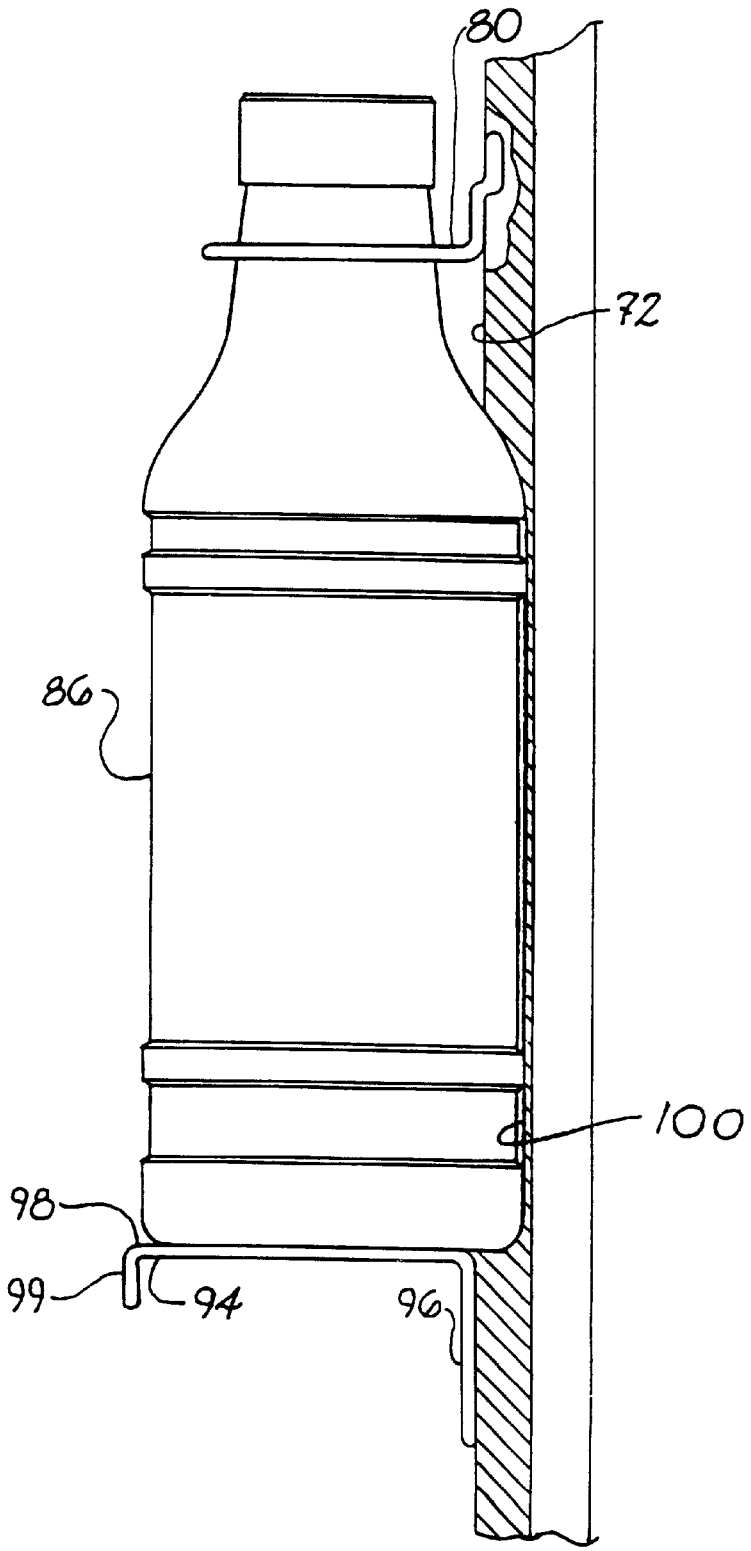
FIG. 12 is a side plan view as partially cut away and shows additional features of the embodiment of FIG. 11.

As seen in the additional embodiment of FIGS. 11 and 12, the display case 70 may define an interior horizontal support as seen here in the form of a shelf 94. Shelf 94 may be in the form of an "L"-shaped metal or plastic bracket which is secured along a flat surface 96 to rear wall 72 of the display case. The horizontal support portion 98 of shelf 94 may then be used to partially support a base portion of containers 86, the depth of support 98 being slightly greater than the depth of the container 86. A downturned lip portion 99 may be present which softens the appearance of shelf 94 and removes a potentially sharp edge.

As best seen in reference to FIG. 12, a hanger 80 seen in this embodiment as a generally "U"-shaped structure, is adapted to operatively engage the neck region of a container when placed on a shelf 94. Hanger 80 is attached to wall 72 by insertion of the respective hanger ends into a pair of spaced apertures defined by wall 72. The attachment of the hanger to an apertured surface is conventional within the art.

The additional use of the hanger 80 affords several advantages in placement of the product on the shelf 94. One advantage is the hanger 80 is unobtrusive and does not detract from the overall appearance of the beverage container. Further, the hanger 80 prevents vibrations from the refrigeration components of the cooler or operation of the cooler sliding door from changing the position of the product being displayed within display case 70. Securing the container neck by hanger 80 maintains the product in a preferred orientation. As such, vibrations of shelf 94 will not rearrange the position or arrangement of the displayed product. As a result, an attractive, orderly display of product within the display case is achieved and maintained.

In accordance with the present invention, the front housing 71 of the display case 70 is pivotally mounted to permit access to the interior of the display case in order to allow the user to change the containers that are displayed in the case. The display case includes a pivoting mechanism connected to the housing and supporting the housing 71 in selective pivoting movement toward and away from the rear wall 72 of the display case. The pivot point for the front housing can be located through the lower portion of the end panel 75 of the housing 71. As shown in FIGS. 4 and 8B for example, the pivoting mechanism can include a shoulder screw 81 disposed at the lower portion of each end 75 of housing 71. As shown in FIG. 8B, the bottom portion of the side panels 75 of housing 71 are configured to provide clearance from the front edge of bottom wall 92 and bottom support flange 89 when housing 71 is swung away from rear wall 72 of display case 70.

Figure 3:
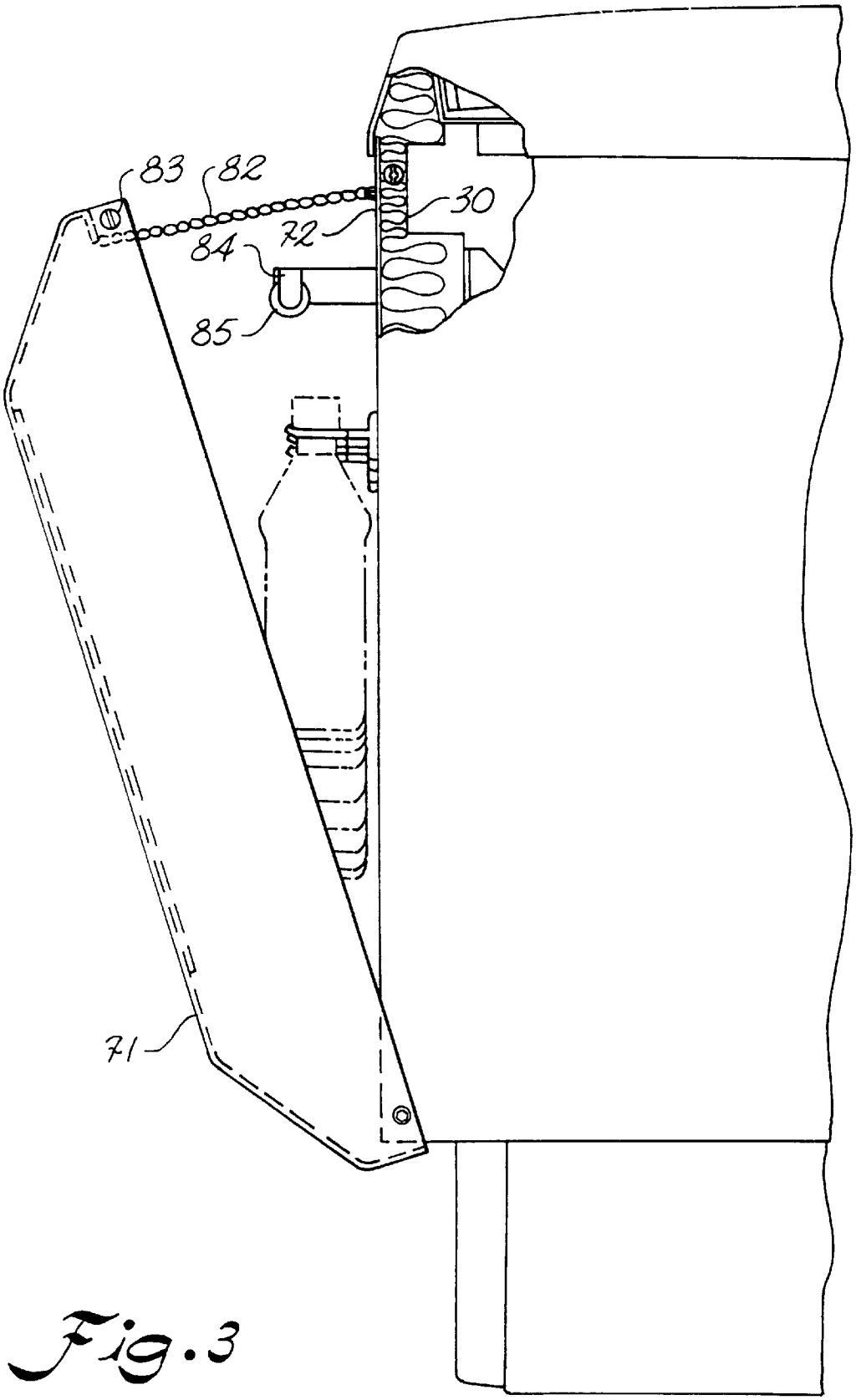
FIG. 3 is a side plan view that is partially cut away and shows some features in dashed line that otherwise would be hidden from view and shows bottles in chain-dashed line.

As shown in the embodiment of FIGS. 3 and 4, when the display case is disposed across the front wall of the cooler's cabinet for example, a shoulder screw 81 can be inserted through an opening formed through the lower portion of the housing's end panel 75 and screwed into the end wall of the cooler to provide an axle for pivoting movement of the housing 71. In an embodiment like that shown in FIG. 7, when the display case is disposed along the top rear of the cooler for example, the bottom support flange 89 can include a rearwardly projecting flange 93 (FIG. 8B) to which the shoulder screw 81 is attached, and housing 71 can pivot about shoulder screw 81 toward and away from rear wall 72.

As shown in FIGS. 3 and 4 for example, the opposite ends of a chain 82 can be attached to the rear wall 72 of the display case and the upper portion of the front housing 71 in order to limit the travel of the front housing 71 when it is opened to allow access to the interior of the case. Desirably, one such chain 82 can be disposed at each opposite end of the case 70.

The display case 70 desirably includes a locking mechanism connected to the housing and configured to selectively lock the housing to prevent pivoting movement of the housing away from the rear wall of the display case. A locking mechanism that requires a tool for actuation of same, can be provided to maintain the front housing 71 in the closed orientation until it is desired to pivot the front housing 71 away from the rear wall 72 and permit access to the interior of the display case 70. As embodied herein and shown in FIGS. 3, 4 and 8A for example, a locking mechanism can be provided in the form of a quarter turn fastener 83 that is rotatable between an open and locked position by means of a set screw having a recessed head that must be engaged with a key before the user can rotate same, however, any conventional latching and/or locking mechanism may be used as fastener 83, such as a conventional cabinet latch or lock.

The display case desirably includes a lighting fixture that is disposed in the case's interior space that is defined between the housing and the rear wall of the case. The lighting fixture is desirably configured to illuminate the interior of the display case from above the hangers when the housing is locked to the rear wall of the case. As shown in FIGS. 2–4 for example, a lighting fixture 84 that holds an elongated flourescent lamp 85 can be configured and disposed in the upper front portion of the interior of the display case of the refrigerated cooler. Desirably, the lighting fixture 84 is attached to the rear wall 72 of the case. In the embodiment shown in FIG. 7, no lighting fixture is needed in display case 70, since as shown in FIG. 8A, light fixture 31 in light recess 30 can be configured to shine sufficient light for illuminating the contents of display case 70.

As illustrated in FIG. 12, it is further envisioned that the rear wall 72 of the display case 70 may have defined therein a cavity defining a depression 100 having a shape adapted for partially receiving the displayed product. The depression 100 corresponds to the specific shape and contour of the container product, thereby helping to maintain the product in an organized, attractive manner. Further, the partial nesting of the product within the depression 100 prevents unwanted movement of the product from vibrations. In addition, the depression 100 precludes the use of a unlicensed or unauthorized product within the display portion of the cooler. Such an ability helps maintain control by the owner of the cooler of the types and brands of products which are associated with the cooler.

While a preferred embodiment of the invention has been described using specific terms, such description is for illustrative purposes only, and it is to be understood that changes and variations may be made without departing from the spirit or scope of the following claims.

What is claimed is:

1. A top-access, refrigerated beverage merchandiser, comprising:

a cabinet defining a generally horizontally extending top, a generally vertically extending front wall, a generally vertically extending back wall opposed to said front wall, and a pair of generally vertically extending and opposed side walls connected between said front and back walls, said cabinet walls defining an exterior and an interior, said cabinet defining an opening through said top, said opening communicating with said interior;

a storage compartment disposed in said interior of said cabinet and defining an entrance at one end of said storage compartment, said entrance communicating with said opening in said top of said cabinet, said storage compartment being defined partially by said front wall;

a display case disposed on said top of said cabinet and configured to contain a product display case, said display case including a window configured to allow viewing the contents of said display case;

a light recess configured and disposed in said front wall near said entrance of said storage compartment and further configured to allow light to communicate between said recess and said storage compartment;

a lighting fixture disposed in said light recess; and a cover disposed between said recess and said storage compartment, said cover configured as a lens, said lens configured to direct light both into said storage compartment and onto said window of said display case.

2. A display case for showcasing the product stored in a refrigerated beverage merchandiser, the display case comprising:

a housing having a front panel, said front panel defining a window;

a transparent member configured and disposed to cover said window;

a rear wall configured to be selectively joined to said housing to enclose and define the interior of said display case and;

a hanger configured to support at least one unit of the product for visual exposure through said window, said hanger being configured to be selectively attached to said rear wall.

3. A case as in claim 2, further comprising:

a pivoting mechanism connected to said housing and supporting said housing in selective pivoting movement toward and away from said rear wall of said display case.

4. A case as in claim 3, further comprising:

a locking mechanism connected to said housing and configured to selectively lock said housing to prevent pivoting movement of said housing away from said rear wall of said display case.

5. A case as in claim 2, further comprising:

a lighting fixture disposed in said housing and configured to illuminate said interior of the display case from above said hangers.

6. A case as in claim 2 connected to the exterior of a cabinet defining an interior and including:

a storage compartment disposed in said interior of said cabinet and defining an entrance at one end of said storage compartment;

a light recess disposed near said entrance of said storage compartment and configured to communicate with said storage compartment; and a lighting fixture disposed in said light recess and configured to project light across said entrance of said storage compartment and onto the product stored uppermost in the storage compartment.

7. The display case according to claim 2 wherein the rear wall of the display case supports a shelf, the shelf positioned at a fixed distance below the hanger.

8. The display case according to claim 2 wherein a plurality of hangers are selectively attached to a rear wall, each of said plurality of hangers configured to support a corresponding unit of product, a rear wall of the display case supporting a shelf providing a horizontal support member configured to support a base of each said corresponding unit of product, the horizontal support member positioned a fixed distance beneath each of said plurality of hangers.

9. A refrigerated beverage merchandiser, comprising:

a cabinet defining an exterior and an interior;

a storage compartment disposed in said interior of said cabinet and defining an entrance at one end of said storage compartment;

a light recess disposed near said entrance of said storage compartment and configured to communicate with said storage compartment;

a lighting fixture disposed in said light recess and configured to project light across said entrance of said storage compartment and onto the product stored uppermost in the storage compartment;

a plenum disposed in said interior of said cabinet, said plenum defining a fan housing and a return chamber, said fan housing being disposed in an upper portion of said plenum and said return chamber being disposed in a lower portion of said plenum and beneath said fan housing;

a divider wall defining an upper section and a lower section disposed beneath said upper section, said divider wall being disposed between said storage compartment and said plenum, said divider wall defining at least one upper air passage in said upper section and at least one air passage in said lower section;

a least one top louver defined in said upper section of said divider wall and configured and disposed to direct air to flow through said upper air passage from said fan housing into said storage compartment, said top louver being angled at an acute angle with respect to the vertical;

a least one bottom louver defined in said lower section of said divider wall and configured and disposed to direct air to flow through said lower air passage from said storage compartment into said return chamber;

an alignment mechanism disposed and configured in said storage compartment for maintaining the contents of said storage compartment in an orderly array, said alignment mechanism including at least one base tray and at least one cap rack disposed in alignment with and opposed to said base tray, said base tray being configured to receive and surround the bases of a plurality of aligned beverage containers, said cap rack being configured to receive and surround the portions of a plurality of aligned beverage containers that provide access to the beverage stored in the containers;

said cap rack being disposed adjacent said top louver and said bottom louver and including a pair of spaced apart wires having opposite ends anchored to said divider wall and having opposite end portions extending outwardly away from said divider wall sufficiently to capture one side of the portions of a plurality of aligned beverage containers that provide access to the beverage stored in the containers that are disposed in said alignment mechanism, said wires having elongated intermediate portions configured to extend for substantially the height of said storage compartment, said wires in each said pair being spaced apart to allow sufficient clearance for the portions of a plurality of aligned beverage containers that provide access to the beverage stored in the containers to be disposed between said wires;

an evaporator fan disposed in said fan housing, said fan having a rotatable shaft and a blade attached to said shaft, said shaft being disposed at an acute angle relative to the vertical and generally parallel to said acute angle of said top louver;

an evaporator disposed in said plenum between said fan housing and said return chamber;

a display case configured for product display and defining an interior and an exterior, said display case being connected to said exterior of said cabinet, said display case defining a housing having a front panel, said front panel defining a window, said display case including a transparent member configured and disposed to cover said window, said display case including a rear wall configured to be selectively joined to said housing to enclose said interior of said display case, said display case including a hanger configured to support at least one unit of the product for visual exposure through said window, said hanger being configured to be selectively attached to said rear wall, said display case including a pivoting mechanism connected to said housing and supporting said housing in selective pivoting movement toward and away from said rear wall of said display case, said display case including a locking mechanism connected to said housing and configured to selectively lock said housing to prevent pivoting movement of said housing away from said rear wall of said display case, said display case including a lighting fixture disposed in said housing and configured to illuminate said interior of said display case from above said hangers when said housing is locked to said cabinet.

10. An apparatus as in claim 9, wherein the shape of said window is contoured to include at least one arcuate section.

11. An apparatus as in claim 9, further comprising a plurality of said hangers attached to said rear wall and disposed in a pattern that mimics the contour of said arcuate section of said window.

12. An apparatus as in claim 9, wherein said cabinet has a top portion and said display case is disposed above said top portion of said cabinet.

13. An apparatus as in claim 9, wherein said cabinet has a front exterior wall and said display case is disposed in front of said front exterior wall of said cabinet.

14. An apparatus as in claim 13, wherein said rear wall of said display case is provided by said front exterior wall of said cabinet.

15. A refrigerated beverage merchandiser, comprising:

a cabinet defining an exterior and an interior;

a storage compartment disposed in said interior of said cabinet and defining an entrance at one end of said storage compartment;

a light recess disposed near said entrance of said storage compartment and configured to communicate with said storage compartment;

a lighting fixture disposed in said light recess and configured to project light across said entrance of said storage compartment and onto the product stored uppermost in the storage compartment;

a plenum disposed in said interior of said cabinet, said plenum defining a fan housing and a return chamber, said fan housing being disposed in an upper portion of said plenum and said return chamber being disposed in a lower portion of said plenum and beneath said fan housing;

a divider wall defining an upper section and a lower section disposed beneath said upper section, said divider wall being disposed between said storage compartment and said plenum, said divider wall defining at least one upper air passage in said upper section and at least one air passage in said lower section;

a least one top louver defined in said upper section of said divider wall and configured and disposed to direct air to flow through said upper air passage from said fan housing into said storage compartment, said top louver being angled at an acute angle with respect to the vertical;

a least one bottom louver defined in said lower section of said divider wall and configured and disposed to direct air to flow through said lower air passage from said storage compartment into said return chamber;

an alignment mechanism disposed and configured in said storage compartment for maintaining the contents of said storage compartment in an orderly array, said alignment mechanism including at least one base tray and at least one cap rack disposed in alignment with and opposed to said base tray, said base tray being configured to receive and surround the bases of a plurality of aligned beverage containers, said cap rack being configured to receive and surround the portions of a plurality of aligned beverage containers that provide access to the beverage stored in the containers;

said cap rack being disposed adjacent said top louver and said bottom louver and including a pair of spaced apart wires having opposite ends anchored to said divider wall and having opposite end portions extending outwardly away from said divider wall sufficiently to capture one side of the portions of a plurality of aligned beverage containers that provide access to the beverage stored in the containers that are disposed in said alignment mechanism, said wires having elongated intermediate portions configured to extend for substantially the height of said storage compartment, said wires in each said pair being spaced apart to allow sufficient clearance for the portions of a plurality of aligned beverage containers that provide access to the beverage stored in the containers to be disposed between said wires;

a wedge-shaped rack disposed between said base tray and said cap rack;

an evaporator fan disposed in said fan housing, said fan having a rotatable shaft and a blade attached to said shaft, said shaft being disposed at an acute angle relative to the vertical and generally parallel to said acute angle of said top louver;

an evaporator disposed in said plenum between said fan housing and said return chamber;

a display case configured for product display and defining an interior and an exterior, said display case being connected to said exterior of said cabinet, said display case defining a housing having a front panel, said front panel defining a window, said display case including a transparent member configured and disposed to cover said window, said display case including a rear wall configured to be selectively joined to said housing to enclose said interior of said display case, said display case including a hanger configured to support at least one unit of the product for visual exposure through said window, said hanger being configured to be selectively attached to said rear wall, said display case including a pivoting mechanism connected to said housing and supporting said housing in selective pivoting movement toward and away from said rear wall of said display case, said display case including a locking mechanism connected to said housing and configured to selectively lock said housing to prevent pivoting movement of said housing away from said rear wall of said display case, said display case including a lighting fixture disposed in said housing and configured to illuminate said interior of said display case from above said hangers when said housing is locked to said cabinet.

16. A display case for showcasing the product stored in a refrigerated beverage merchandiser, the display case comprising:

a housing having a front panel, said front panel defining a window;

a transparent member configured and disposed to cover said window;

a rear wall configured to be selectively joined to said housing to enclose and define the interior of said display case;

a hanger configured to support at least one unit of the product for visual exposure through said window, said hanger being configured to be selectively attached to said rear wall; and wherein said rear wall of said display case defines a depression, said depression being adapted for receiving partially therein a corresponding unit of product having a similar shape.

17. A refrigerated beverage merchandiser, comprising:

a cabinet defining an exterior and an interior and a top defining an opening configured to permit access to said interior of said cabinet;

a divider wall extending generally vertically and being disposed in said interior of said cabinet wherein one side of said divider wall defines a wall of a storage compartment and an opposite side of said divider wall defines a wall of a plenum, said divider wall defining an upper section and a lower section disposed beneath said upper section, said divider wall defining at least one upper air passage in said upper section and at least one lower air passage in said lower section;

said storage compartment being disposed in said interior of said cabinet and defining an entrance communicating with said opening of said cabinet;

said plenum being disposed in said interior of said cabinet and defining an upper portion and a lower portion;

an evaporator fan disposed in said plenum;

an evaporator disposed in said plenum;

an equipment compartment disposed beneath said storage compartment, said equipment compartment having a first side and a second side;

a compressor disposed in said second side of said compartment; and a fan that is configured and disposed in said equipment compartment so as to operate to draw air into said first side of said equipment compartment and thence from said first side of said equipment compartment and into said second side of said equipment compartment and thence expel said air out of said second side of said equipment compartment.

18. A refrigerated beverage merchandiser as in claim 17, further comprising:

an alignment mechanism disposed in said storage compartment and configured for maintaining the contents of said storage compartment in an orderly array;

a least one top louver defined in said upper section of said divider wall and configured and disposed to direct air to flow through said upper air passage from said upper portion of said plenum into said storage compartment, said top louver being angled at an acute angle with respect to the vertical; and a least one bottom louver defined in said lower section of said divider wall and configured and disposed to direct air to flow through said lower air passage from said storage compartment into said lower portion of said plenum.

19. A refrigerated beverage merchandiser as in claim 18, wherein said evaporator fan is disposed in said upper portion of said plenum, said fan having a rotatable shaft and a blade attached to said shaft, said shaft being disposed at an acute angle relative to the vertical and generally parallel to said acute angle of said top louver and said evaporator is disposed between said evaporator fan and said lower portion of said plenum.

20. A refrigerated beverage merchandiser as in claim 17, further comprising:

a bottom wall disposed generally horizontally in said interior of said cabinet and defining a bottom wall of said storage compartment and facing opposite said entrance of said storage compartment; and a wedge-shaped rack disposed on said bottom wall of said storage compartment and configured to support the contents of said storage compartment at an angle with the end of the contents disposed closer to said divider wall being supported at a higher elevation than the end of the contents disposed farther away from said divider wall.

21. A refrigerated beverage merchandiser as in claim 18, wherein said alignment mechanism includes:

a front wall and a rear wall disposed generally opposite said front wall;

said front wall defining a vertically extending portion having an upper end and a lower end disposed opposite said upper end, a first edge portion that extends forwardly from said upper end of said vertically extending portion and generally away from said rear wall, and a base portion that extends rearwardly toward said rear wall from said lower end of said vertically extending portion, said base portion including a first transverse member and a second transverse member spaced apart from said first transverse member;

said rear wall defining a vertically extending portion having an upper end and a lower end disposed opposite said upper end, a second edge portion that is rearwardly extending from said upper end of said vertically extending portion and away from said front wall, and a base portion that extends forwardly toward said front wall from said lower end of said vertically extending portion, said base portion defining a hook segment; and wherein said base portion of said rear wall passes under said first transverse member of said base portion of said front wall and said hook segment of said base portion of said rear wall passes over and engages said second transverse member of said base portion of said front wall.

22. A refrigerated beverage merchandiser as in claim 17, further comprising:

at least one door that is slidably disposed in said top of said cabinet to selectively open and close access through said opening into said interior of said storage compartment.

23. A refrigerated beverage merchandiser as in claim 17, wherein said cabinet defines a front, said first side of said equipment compartment defines a first opening through said front of said cabinet and said second side of said equipment compartment defines a second opening through said front of said cabinet.

24. A refrigerated beverage merchandiser, comprising:

a cabinet defining an exterior and an interior and a top defining an opening configured to permit access to said interior of said cabinet;

a refrigerated storage compartment disposed in said interior of said cabinet and defining an entrance communicating with said opening of said cabinet, and said storage compartment further defining a front wall and a rear wall disposed opposite said front wall, said storage compartment further defining a bottom wall disposed generally horizontally between said front and back walls and facing opposite said entrance;

an alignment mechanism disposed in said storage compartment and configured for maintaining the contents of said storage compartment in an orderly array, said alignment mechanism including:

a front wall and a rear wall disposed generally opposite said front wall;

said front wall of said alignment mechanism defining a vertically extending portion having an upper end and a lower end disposed opposite said upper end, a forward portion extending from said upper end of said vertically extending portion and generally away from said rear wall of said alignment mechanism and having a first edge engaging said front wall of said storage compartment, and a base portion that extends rearwardly toward said rear wall of said alignment mechanism from said lower end of said vertically extending portion, said base portion including a first transverse member and a second transverse member spaced apart from said first transverse member;

said rear wall of said alignment mechanism defining a vertically extending portion having an upper end and a lower end disposed opposite said upper end, said rear wall of said alignment mechanism further defining a second edge that is rearwardly extending from said upper end of said vertically extending portion and away from said front wall of said alignment mechanism and engaging said rear wall of said storage compartment, and said rear wall of said alignment mechanism further defining a base portion that extends forwardly toward said front wall of said alignment mechanism from said lower end of said vertically extending portion, said base portion of said rear wall of said alignment mechanism defining a hook segment; and wherein said base portion of said rear wall of said alignment mechanism passes under said first transverse member of said base portion of said front wall of said alignment mechanism, and said hook segment of said base member of said rear wall of said alignment mechanism passes over and engages said second transverse member of said base portion of said front wall of said alignment mechanism.

* * * * *